US011504297B2

(12) United States Patent
Fu

(10) Patent No.: US 11,504,297 B2
(45) Date of Patent: Nov. 22, 2022

(54) BODY MASSAGING DEVICE AND METHOD OF OPERATING THE SAME

(71) Applicant: Yidong Fu, Beijing (CN)

(72) Inventor: Yidong Fu, Beijing (CN)

( * ) Notice: Subject to any disclaimer, the term of this patent is extended or adjusted under 35 U.S.C. 154(b) by 707 days.

(21) Appl. No.: 16/461,112

(22) PCT Filed: Aug. 7, 2017

(86) PCT No.: PCT/CN2017/096170
§ 371 (c)(1),
(2) Date: May 15, 2019

(87) PCT Pub. No.: WO2018/095070
PCT Pub. Date: May 31, 2018

(65) Prior Publication Data

US 2019/0282438 A1 Sep. 19, 2019

(30) Foreign Application Priority Data

Nov. 23, 2016 (CN) ..... 201611046350.7

(51) Int. Cl.
*A61H 19/00* (2006.01)

(52) U.S. Cl.
CPC ..... *A61H 19/30* (2013.01); *A61H 19/00* (2013.01); *A61H 2201/164* (2013.01); *A61H 2201/1657* (2013.01); *A61H 2205/086* (2013.01)

(58) Field of Classification Search
CPC ..... A61H 19/30; A61H 19/00; A61H 15/00; A61H 21/00; A61H 2201/164;
(Continued)

(56) References Cited

U.S. PATENT DOCUMENTS 5,531,226 A * 7/1996 Harris ..... A63B 23/20 600/587
5,904,660 A * 5/1999 Kim ..... A61H 1/00 601/118

(Continued)

FOREIGN PATENT DOCUMENTS

CN 201230574 Y 5/2009
CN 103767082 A 5/2014

(Continued)

OTHER PUBLICATIONS

International Search Report issued in International Application No. PCT/CN2017/096170 dated Oct. 26, 2017.

(Continued)

*Primary Examiner* — Samchuan C Yao
*Assistant Examiner* — Tyler A Raubenstraw
(74) *Attorney, Agent, or Firm* — Michele V. Frank; Venable LLP

(57) ABSTRACT

The present disclosure relates to a body massaging device and an operation method thereof, wherein, the body massaging device comprises a support holder detachably mounted on a lower limb of a body; and an anal massaging assembly mounted on the support holder for compressing and/or rubbing an anus of the body as well as perianal skin. The present disclosure provides a support holder to mount the body massaging device at a lower limb of the body and perform a compressing and/or rubbing massage on an anus of the body and a perianal skin by means of an anal massaging assembly mounted on the support holder, so as to stimulate sexually sensitive nerves densely distributed on the anus and the perianal skin, so that a user can obtain a stimulation effect different from the existing penis masturbation appliance or the inserted massaging appliance to stimulate the prostate, when the body massaging device of the present disclosure is used. Moreover, as the body mas- (Continued)

saging device which is mounted at a lower limb of the body is equivalent to a wearable massaging appliance and does not require a user to hold it for a long time, the user is less prone to fatigue during the use.

22 Claims, 9 Drawing Sheets

(58) Field of Classification Search
CPC ..... A61H 2201/1657; A61H 2205/086; A61H 23/02; A61H 19/32; A61H 7/004; A61H 2201/1692; A61H 2205/085; A61H 2205/087; A61H 2201/165; A61H 2201/1642; A61H 2201/1246; A61H 2201/1238; A61H 2201/123; A61H 23/00; A61H 2007/009; A61H 19/34; A61H 19/40; A61H 19/44; A61H 9/00; A61F 5/41; A61F 2005/417
See application file for complete search history.

(56) References Cited

U.S. PATENT DOCUMENTS

| | | | | |
|---|---|---|---|---|
| 6,436,031 | B1 * | 8/2002 | Salib | A61F 5/41 600/39 |
| 9,314,400 | B1 * | 4/2016 | Dudley | A61H 19/30 |
| 2002/0062515 | A1 * | 5/2002 | Wang | A41D 1/06 2/227 |
| 2004/0186343 | A1 * | 9/2004 | Moore-Steele | A61H 19/30 600/38 |
| 2005/0015028 | A1 * | 1/2005 | Luettgen | A61H 19/50 601/72 |
| 2006/0142638 | A1 | 6/2006 | Flores | |
| 2007/0203392 | A1 * | 8/2007 | Jerstad | A61H 19/00 600/38 |
| 2007/0299378 | A1 | 12/2007 | Nan | |
| 2009/0222034 | A1 * | 9/2009 | Takashima | A61H 21/00 606/197 |
| 2010/0292531 | A1 * | 11/2010 | Beaulieu | A61F 5/41 600/38 |
| 2011/0082333 | A1 | 4/2011 | Wilson et al. | |
| 2013/0018221 | A1 * | 1/2013 | Ball | A61H 19/32 600/38 |
| 2014/0350509 | A1 * | 11/2014 | Bigelow | A61H 1/008 604/396 |
| 2014/0378758 | A1 * | 12/2014 | Mankin | A61H 19/44 600/38 |
| 2015/0150752 | A1 * | 6/2015 | Bernstein | A61H 19/44 600/38 |
| 2016/0331629 | A1 * | 11/2016 | Pearson | A61H 19/44 |
| 2016/0346153 | A1 * | 12/2016 | Hodges, IV | A61H 23/02 |

FOREIGN PATENT DOCUMENTS

| | | | | |
|---|---|---|---|---|
| CN | 104274307 | A | 1/2015 | |
| CN | 204169067 | U | 2/2015 | |
| DE | 202010017928 | U1 | 5/2013 | |
| JP | S58-61750 | A | 4/1983 | |
| JP | H9-511164 | A | 11/1997 | |
| JP | 3146490 | U | 11/2008 | |
| JP | 2009-207896 | A | 9/2009 | |
| JP | 3164559 | U | 12/2010 | |
| KR | 10-0948004 | B1 | 3/2010 | |
| KR | 20100130011 | A | 12/2010 | |
| WO | WO-2010078655 | A1 * | 7/2010 | A61H 19/00 |
| WO | 2011002203 | A2 | 1/2011 | |

OTHER PUBLICATIONS

Notice of Reasons for Rejection dated May 27, 2021, directed to JP Application No. 2019-506149; 6 pages.
Extended European Search Report issued in related European U.S. Appl. No. 17/873,729 dated May 19, 2020.

* cited by examiner

BODY MASSAGING DEVICE AND METHOD OF OPERATING THE SAME

CROSS-REFERENCE TO RELATED APPLICATIONS

This application is a National Stage Entry of PCT/CN2016/096170, filed Aug. 7, 2017, which claims priority to CN Application No. 201611046350.7, filed Nov. 23, 2016, the contents of each of which are hereby incorporated by reference in their entireties.

TECHNOLOGY FIELD

The present disclosure relates to the field of sexual health care and sexual entertainment of body, and especially relates to a body massaging device and a method of operating the same.

BACKGROUND

Since a large amount of nerve fibers capable of stimulating the body to cause sexual excitement, sexual pleasure, orgasm and related with ejaculation are gathered in the main sexual organs of the male such as the penis and the anus, as well as such areas as the anal sphincter, the skin of perianal area, the prostate, the perineum, and the crotch around them, these nerve fibers may be stimulated by masturbation or sexual intercourse with a mate, so as to further obtain an intense sexual pleasure and orgasm. Similarly, by massaging these body parts abundant in sexual nerves, it can bring sexual pleasure and orgasm to the male, and at the same time it can also achieve the health care effect of the sexual functions of the male.

At present, there are a large number of body massaging appliances for entertainment, health care, or adjuvant treatment emerging in the market, most of which are masturbation appliances produced for stimulating the penis by sliding, pressing or vibration, including various forms of masturbation cups, simulated vaginas and the like, by referring to the principle that the penis is directly stimulated to produce sexual pleasure during the sexual intercourse with a mate. Although these massaging appliances can achieve stimulation effect to a certain degree, the stimulation effect produced in such manner is relatively boring, and there is a short duration of excitement. On the other hand, these masturbation appliances often need to be held or driven by the user's single hand or both hands, and therefore, the user may be prone to fatigue under long-term operation.

In addition to the masturbation appliances for the penis, there are also masturbating massage appliances for exerting a stimulus to the anus at present. Such massaging appliances with deficient types are typically used in an inserted manner. That is, the prostate is subjected to pressing or friction by a masturbating appliance inserted into the anus as a main stimulation manner, for example various forms of anal plugs, prostate massagers and the like. As such massaging appliances for the anus need to be inserted into the anus, there involves a difficult operation, so that it is difficult to obtain a very intense stimulation effect, and orgasm is not easily achieved during the use. In addition, the user tends to bear safety and hygiene concerns for the manner of insertion into the anus. Likewise, such massage appliances also have the problem that the user is prone to fatigue under long-term operation.

SUMMARY

In view of this, the present disclosure proposes a body massaging device and an operation method thereof, which are capable of providing a stimulation effect different from the existing massaging appliances, and making a user less prone to fatigue during the use.

According to one aspect of the present disclosure, there is provided a body massaging device, including: a support holder, detachably mounted on a lower limb of a body; and an anal massaging assembly mounted on the support holder for compressing and/or rubbing massage on an anus and a perianal skin of the body.

In some embodiments, the support holder includes: a leg clamping structure, for clamping and fixing a leg of the body; and a massaging assembly mounting bracket, mounted on the leg clamping structure, for mounting various massaging assemblies.

In some embodiments, the leg clamping structure includes at least one row of a pair of lateral arms juxtaposed in a linear shape, a curvilinear shape or a corrugated shape, for clamping and fixation by exerting an compressing force to front and rear sides of thighs of the body.

In some embodiments, the leg clamping structure includes at least one set of enclosed fixing band, configured to be sleeved on a thigh of the body whilst exerting a compressing force for clamping and fixation.

In some embodiments, the leg clamping structure includes at least one set of lateral arms and fixing bands, such that an end of the lateral arms is connected with the fixing bands to form an enclosed armband assembly, the enclosed armband assembly configured to be sleeved on a thigh of the body whilst exerting a compressing force for clamping and fixation.

In some embodiments, when the leg clamping structure clamps and fixes a leg of the body, the massaging assembly mounting bracket is positioned between both legs of the body, so that the massaging assembly mounted on the massaging assembly mounting bracket moves relative to the body along with a motion of the leg when the leg of the body performs a preset action.

In some embodiments, a distance between the pair of lateral arms is configured to be adjustable so as to adapt to leg sizes of different bodies or different leg parts of the body.

In some embodiments, the anal massaging assembly includes: an anal massaging arm, mounted on the support holder; and an anal massaging head, which is mounted at one end of the anal massaging arm and configured to exert a compressing force to an anal part under the effect of the anal massaging arm, so as to effectuate a compressing massage on the anus as well as the perianal skin, and which is configured to perform a rubbing massage on the anus as well as the perianal skin by movement of the anal massaging head on the anal massaging arm or movement of the same along with movement of the anal massaging arm.

In some embodiments, the anal massaging arm is rotatably connected to the support holder by means of a rotary shaft disk provided on the support holder, and an elastic element provided between the anal massaging arm and the support holder is configured to exert a torque towards the anal massaging arm, so that the anal massaging head compresses the anus and the perianal skin.

In some embodiments, the elastic element is: a torsion spring provided within the rotary shaft disk, or a spring provided between the support holder and the anal massaging arm, or a spring provided between the rotary shaft disk and the anal massaging arm.

In some embodiments, an elastic force of the elastic element is adjustable.

In some embodiments, a protective housing is provided on an outer side of the rotary shaft disk.

In some embodiments, the anal massaging head is detachable, replaceable and/or adjustable in position with respect to the anal massaging arm.

In some embodiments, the anal massaging head is integrally formed of a single material, or the anal massaging head includes a base body and a flexible surface layer material covered on at least a partial surface of the base body.

In some embodiments, a portion of the anal massaging head for contacting the anus and the perianal skin is configured to be a smooth surface, a corrugated surface, a granular surface, a concave-convex surface or a surface with an adjustable shape.

In some embodiments, further including a vibration motor provided on the anal massaging arm or the anal massaging head, for making the anal massaging head produce a continuous vibration effect.

In some embodiments, the anal massaging arm includes: a telescopic rod, one end of which is connected with the anal massaging head; and a telescopic drive mechanism, for driving the telescopic rod to perform a telescopic action so that the anal massaging head exerts a sliding stimulus to the anus and the perianal skin.

In some embodiments, further including a sphincter massaging head and a sphincter massaging arm which is selectively provided, wherein, the sphincter massaging head is mounted on the anal massaging assembly and/or the support holder directly or by means of the sphincter massaging arm, and located on left and right sides or front and rear sides of the anal massaging assembly, for performing a compressing and/or rubbing massage on the anal sphincter.

In some embodiments, the sphincter massaging head is detachable, replaceable and/or adjustable in position with respect to the sphincter massaging arm, the anal massaging assembly and/or the support holder.

In some embodiments, a portion of the sphincter massaging head for contacting the anal sphincter is configured to be a smooth surface, a corrugated surface, a granular surface, a concave-and-convex surface or a surface with an adjustable shape.

In some embodiments, the sphincter massaging head is formed of a single material, or the sphincter massaging head includes a base body and a flexible surface material covered on at least a partial surface of the base body.

In some embodiments further including a penis massaging assembly mounted on the support holder for performing a compressing and/or rubbing massage on a penis of the body.

In some embodiments, the penis massaging assembly includes: a penis massaging arm mounted on the support holder; and a penis massaging head mounted at one end of the penis massaging arm, for exerting a compressive force to the penis, so as to effectuate a compressing massage on the penis, and performing a rubbing massage on the penis along with movement of the penis with respect to the penis massaging head.

In some embodiments, the penis massaging arm is detachably and/or rotatably mounted on the support holder.

In some embodiments, the penis massaging head is detachable, replaceable and/or adjustable in position with respect to the penis massaging arm.

In some embodiments, the penis massaging head includes an at least partially enclosed tubular structure, or a plurality of at least partially enclosed annular structures arranged along a length direction of the penis massaging arm, in which a hollow portion of the tubular structure or the annular structure is configured to receive the penis.

In some embodiments, the tubular structure or the annular structure is an elastic structure or is made of an elastic material, or an inner wall of the tubular structure or the annular structure is an elastic structure or is made of an elastic material, or an inner wall of the tubular structure or the annular structure is configured in a contour shape that substantially matches an outer contour of the penis, or an entirety or an inner wall portion of the tubular structure or the annular structure is a non-elastic structure or is made of a non-elastic material.

In some embodiments, the tubular structure or the annular structure is lined with a flexible massaging cushion, wherein an inner surface of the flexible massaging cushion in contact with the penis is configured to be a smooth surface, a corrugated surface, a granular surface, or a concave-convex surface.

In some embodiments, the flexible massaging cushion includes a flexible surface layer and a flexible filler, in which the flexible filler is disposed between the flexible surface layer and an inner wall of the tubular structure or the annular structure.

In some embodiments, further including a perineum massaging assembly mounted on the support holder, the anal massaging assembly and/or the penis massaging assembly for performing a compressing and/or rubbing massage on a perineum of the body.

In some embodiments, the perineum massaging assembly includes a perineum massaging head and a perineum massaging arm which is selectively provided, in which the perineum massaging head is mounted on the support holder, the anal massaging assembly and/or the penis massaging assembly directly or by means of the perineum massaging arm.

In some embodiments, the perineum massaging arm and/or the perineum massaging head is bendable as to form various angles or shapes so that the perineum massaging head matches with the perineum.

In some embodiments, the perineum massaging head is detachable, replaceable and/or adjustable in position with respect to the perineum massaging arm, the support holder, the anal massaging assembly and/or the penis massaging assembly directly mounted thereby.

In some embodiments, a portion of the perineum massaging head for contacting the perineum is configured to be a smooth surface, a corrugated surface, a granular surface, or a concave-convex surface.

In some embodiments, the perineum massaging head is integrally formed of a single material, or the perineum massaging head includes a base body and a flexible surface layer material covered on at least a partial surface of the base body.

In some embodiments, further including an insertion-type prostate massager mounted on the support holder directly or by means of the anal massaging assembly, for insertion into the anus to perform a compressing and/or rubbing massage on a prostate interior to the anus.

In some embodiments, further including a bearing garment wearable on at least leg and waist-hip parts of the body, and bearing the support holder, to assist in fixation of the support holder on the lower limb of the body, the bearing garment further at least partially wrapping the support holder and various massaging assemblies mounted on the support holder, so as to assist various massaging assemblies to approach corresponding positions of the body.

In some embodiments, the bearing garment is a bearing shorts, wherein, an upper side of the bearing shorts is provided with a waist-hip wrapping portion which has a waist belt, a pulling rope or an elastic rope for adjusting a wrapped size, a lower side of the bearing shorts is provided with leg wrapping portions wrapping the thighs of the body, and a crotch wrapping portion is provided between the leg wrapping portions at both sides, such that the waist-hip wrapping portion, the leg wrapping portions and the crotch wrapping portion jointly bear the support holder, and jointly wrap the support holder and various massaging assemblies on the support holder.

In some embodiments, the crotch wrapping portion is provided with a liquid collecting bag, for collecting lubricant and body fluid secreted by the body in a massaging process, and isolating the lubricant and the body fluid from the body.

In some embodiments, a vest band is mounted on the waist-hip wrapping portion, the vest band being connected to the support holder and various massaging assemblies mounted on the support holder, to assist in a bearing effect of the bearing shorts.

In some embodiments, an opening is provided on a front side of the bearing shorts, so that a penis of the body protrudes from the opening.

In some embodiments, the anal massaging assembly includes an anal massaging arm mounted on the support holder and an massaging head mounted at one end of the anal massaging arm, and a support rod mounted on the anal massaging arm or the anal massaging head in the anal massaging assembly, wherein, the support rod supports a rear side of the bearing shorts, so that the anal massaging head abuts against the anus and the perianal skin by a bearing of the bearing shorts and the support rod.

In some embodiments, a plug is provided at an end of the support rod, and a supporting and fixing portion is provided at a rear side of the bearing shorts, wherein, the supporting and fixing portion is provided with a plurality of plug fixing holes matable with the plug, and the plug is selectably plugged into any one of the plug fixing holes, so as to adjust a fixed position of the support rod.

In some embodiments, further including an electric, pneumatic or hydraulic driving mechanism for driving various massaging assemblies mounted on the massaging assembly mounting bracket to realize automatic massage.

According to another aspect of the present disclosure, there is provided an operation method based on the aforementioned body massaging device, which includes: mounting the support holder on a lower limb of a body and making the anal massaging assembly abut against a position of an anus of the body; and making the anal massaging assembly perform a compressing and/or rubbing massage on the anus and the perianal skin of the body by a predetermined repetitive action performed by the body.

In some embodiments, the predetermined repetitive action is a repeated flexion and extension action of a waist or a knee in a standing state of the body.

In some embodiments, the support holder includes: a leg clamping structure for clamping and fixing a leg of the body and a massaging assembly mounting bracket mounted on the leg clamping structure and for mounting various massaging assemblies; the operation method further includes: making the various massaging assemblies mounted on the massaging assembly mounting bracket abut against corresponding positions of the body when the support holder is mounted on the leg of the body; and making the various massaging assemblies perform a compressing and/or rubbing massage on corresponding positions of the body when the body performs a predetermined repetitive action.

In some embodiments, the body massaging device further includes an electric, pneumatic or hydraulic driving mechanism; the operation method further includes: activating the electric, pneumatic or hydraulic driving mechanism, so as to drive various massaging assemblies of the massage assembly mounting bracket to effectuate automatic massage after various massaging assemblies mounted on the massage assembly mounting bracket abut against corresponding positions of the body.

In some embodiments, the body massaging device further includes a bearing garment; the operation method further includes: wearing the bearing garment at leg and waist-hip parts of the body, so as to bear the support holder by the bearing garment and at least partially wrapping the support holder and various massaging assemblies mounted on the support holder, after making various massaging assemblies mounted on the massage assembly mounting bracket abut against corresponding positions of the body.

Therefore, according to embodiments of the present disclosure, there is provided a support holder to mount the body massaging device at a lower limb of the body and performing a compressing and/or rubbing massage on an anus and a perianal skin of the body by means of an anal massaging assembly mounted on the support holder, so as to stimulate sexually sensitive nerves densely distributed on the anus and the perianal skin, so that a user can obtain a stimulation effect different from the existing penis masturbation appliance or the inserted massaging appliance to stimulate the prostate when the body massaging device of the present disclosure is used. Moreover, as the body massaging device which is mounted on a lower limb of the body is equivalent to a wearable massaging appliance and does not require a user to hold it for a long time, the user is less prone to fatigue during the use.

BRIEF DESCRIPTION OF THE DRAWINGS

The drawings described herein are used to provide a further understanding of the present disclosure and constitute a part of the present application. The illustrative embodiments of the present disclosure as well as the descriptions thereof, which are used for explaining the present disclosure, do not constitute improper definitions on the present disclosure. In the drawings.

It should be understood that, the dimensions of various parts shown in the drawings are not delineated according to actual proportional relationships. In addition, the same or similar reference numerals denote the same or similar members.

EMBODIMENTS

Various exemplary embodiments of the present disclosure will now be described in detail with reference to the accompanying drawings. The descriptions of the exemplary embodiments which are merely descriptive, by no means serve as any delimitation on the present disclosure as well as its application or use. The present disclosure may be embodied in many different forms, not limited to the embodiments described here. These embodiments are provided so that the present disclosure is thorough and complete, and adequately presents the scope of the present disclosure to those skilled in the art. It should be noted that, unless otherwise specified, the relative arrangements of the components and steps expounded in these embodiments should be construed as merely illustrative, rather than as a delimitation.

The words "first", "second", and similar words used in the present disclosure do not denote any order, quantity or importance, but merely serve to distinguish different parts. Such similar words as "comprising/including" or "containing" mean that the element preceding the word encompasses the elements enumerated after the word, and does not exclude the possibility of encompassing other elements as well. "Up", "down", "left", "right", and the like are used only to present relative positional relationships, which may also be possibly changed correspondingly when a change is made to an absolute position of the described object.

In the present disclosure, when it is described that a particular device is located between the first device and the second device, there may be an intermediate device between the particular device and the first device or the second device, and alternatively, there may be no intermediate device. When it is described that a particular device is connected to other devices, the particular device may be directly connected to said other devices without an intermediate device, and alternatively, may not be directly connected to said other devices but with an intermediate device.

All the terms (including technical and scientific terms) used in the present disclosure have the same meanings as understood by those skilled in the art of the present disclosure unless otherwise defined. It is also to be understood that the terms defined in for example general-purpose dictionaries should be construed as having meanings consistent with those in the context of the related art, rather than being construed in an idealized or extremely formalized sense unless explicitly thus defined here.

The techniques, methods, and devices known to a common technical person in the relevant art may not be discussed in detail, but where appropriate, the techniques, methods, and devices should be considered as part of the description.

Figure 1:
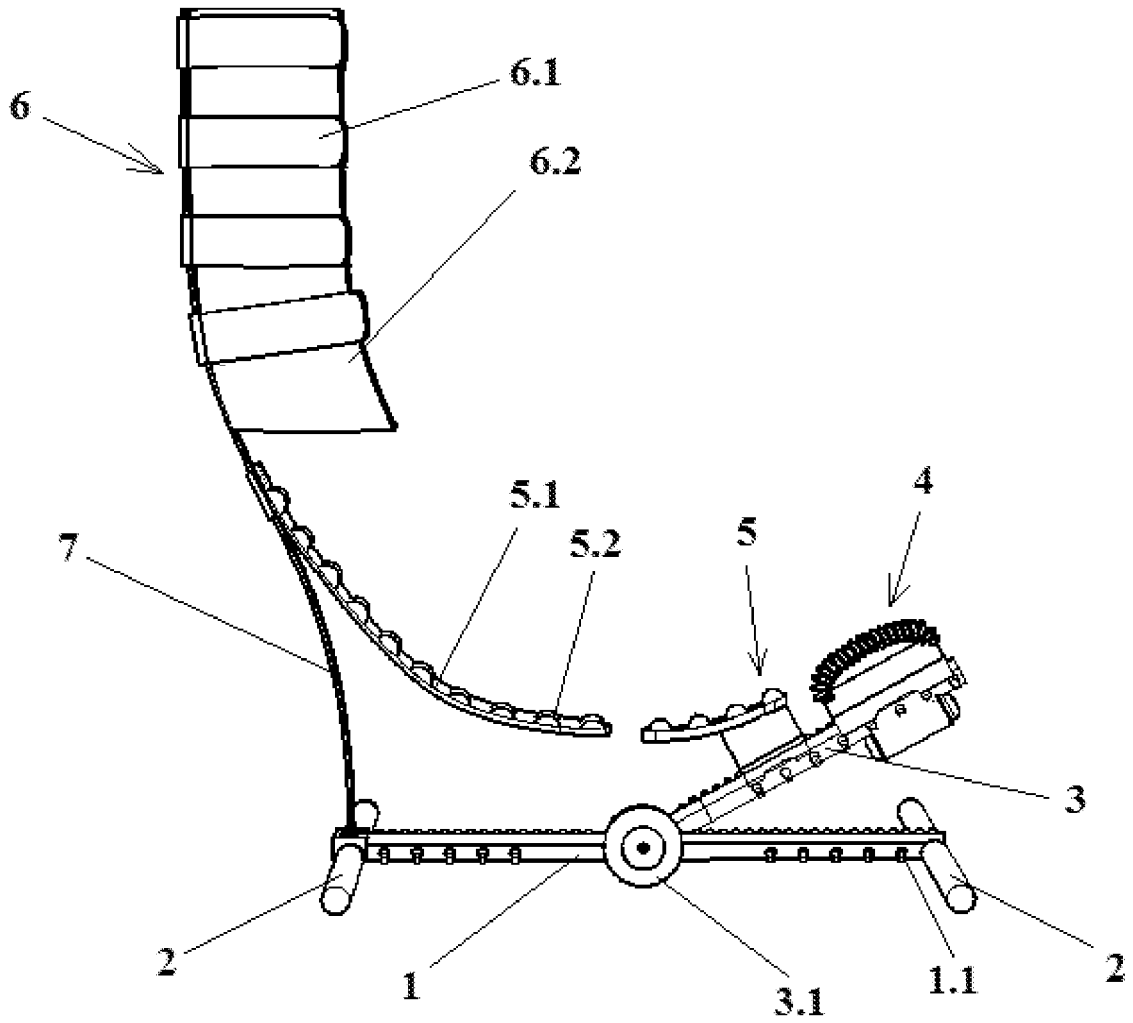
FIG. 1 is a schematic structural view according to some embodiments of the body massaging device according to the present disclosure.

As shown in FIG. 1, it is a schematic structural view according to some embodiments of the body massaging device according to the present disclosure. Referring also to a perspective view shown in FIG. 2, the body massaging device in the present embodiment includes a support holder and an anal massaging assembly. Among them, the support holder is detachably mounted on a lower limb of a body, while the anal massaging assembly is mounted on the support holder for compressing and/or rubbing massage on an anus and a perianal skin of the body.

The support holder is present with at least one function for the body massaging device. That is, it is detachably mounted on a lower limb of the body to achieve its fixing effect with respect to the body. This fixed effect may allow that the body massaging device does not easily come off from the body when the body stands, so that the body massaging device is worn on the body in this sense. When the body bends the knees or bends the waist or walks, the anal massaging assembly is movable or swingable with respect to the anus and the perianal skin, thereby producing a slide rubbing effect with respect to the anus and the perianal skin. By making these predetermined actions, the user can prompt various massaging assemblies mounted on the support holder to move or swing among various sexually sensitive areas of the body, thereby performing a slipping friction over various sexually sensitive areas of the body.

As the anal massaging assembly is mainly directed to a compressing and/or rubbing massage on the anus and the perianal skin of the body. This manner does not require the user to insert the massaging head into the body cavity from the anus, so it is more safe and sanitary in use, and the user is also less worried during the use. Moreover, as the anus and the perianal skin are densely distributed with sexually sensitive nerves, the massage in the compressing and rubbing manners may allow the user to obtain a stimulation effect different from the existing penis masturbation appliance or the inserted massaging appliance to stimulate the prostate.

In addition, although some masturbation massaging appliances also possess the function of massaging the anus, they are usually required to be fixed on a particular platform or on the ground, and the user needs to have his knees seated on the appliances, so it is very inconvenient during the use. Moreover, the user is prone to fatigue when maintaining a posture of kneeling for a long time, thus affecting the operational feeling. Further, since the anal massaging assembly in the present embodiments is mounted on the support holder, by fixing the support holder with respect to the body, it is also possible to stimulate the anus and the perianal skin for a long time without requiring the user to hold it in hand for long, so that the user is less prone to fatigue during the use.

Figure 2:
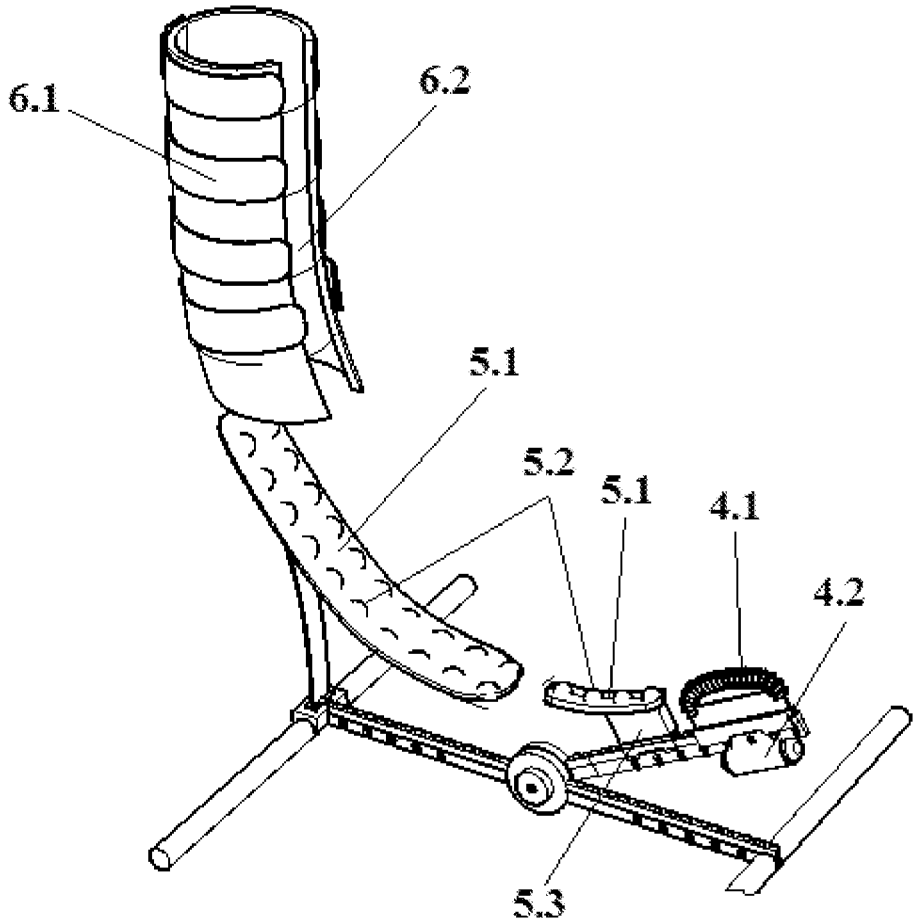
FIG. 2 is a schematic perspective view of the embodiments of FIG.1.

In FIGS. 1 and 2, the support holder mainly includes two parts, in which one part is a leg clamping structure 2, and the other part is a massaging assembly mounting bracket 1. The leg clamping structure 2 is used for clamping and fixing a leg of the body. As mentioned earlier, the support holder is fixed with respect to a lower limb of the body, at a position which is selectively at a leg portion, especially at a thigh portion. According to a specific supporting and fixing form, in other embodiments, the support holder may also be fixed on the calf or the ankle, or may be fixed on the thigh and the calf at the same time.

The leg clamping structure 2 may specifically include at least one row of a pair of lateral arms juxtaposed in a linear shape, a curvilinear shape or a corrugated shape, for performing clamping and fixation by exerting a force to front and rear sides of thighs of the body at the same time. As can be seen from FIG. 1, the pair of lateral arms located at the front and rear in FIG. 1 are both in a straight linear shape. When the user mounts the leg clamping structure 2, it is necessary to pass the leg through the space between the pair of lateral arms, and the leg clamping structure 2 is maintained to be fixed with respect to the leg by utilizing a frictional force of the skin and the elasticity of the muscles of the leg.

Considering the different dimensional proportion of the legs of the users, or the different mounting positions chosen by users, it is possible to enable a distance between the pair of lateral arms to be adjusted therebetween, so as to adapt to the dimensions of the legs of different bodies or different leg parts of the body, and control the strength in clamping the legs. In other embodiments, there may be a greater amount of lateral arms, for example two or more rows of pairs of lateral arms provided along a height direction, so as to clamp and fix the leg at a plurality of positions. The shape of the lateral arms of the leg clamping structure 2 may also be a curved shape or a corrugated shape, to adapt to the curve of the legs of the body, so as to reduce the uncomfortable feeling resulting from the lateral arm compressing the muscles of the legs.

In further embodiments of the body massaging device according to the present disclosure, the leg clamping structure may also include at least one set of enclosed fixing bands, equivalent to a loop structure, which can be sleeved on the thighs of the body whilst exerting a compressive force to the thighs to realize the effect of clamping and fixing the legs. The fixing band may be an elastic or non-elastic rope, or elastic or non-elastic band. During the use, the user may directly pass the thigh through an enclosed hollow area formed by the fixing band until it is fastened to a suitable part with the thigh, and may also perform the fixation on the leg in a binding or buckled manner.

In further embodiments, the leg clamping structure may include at least one set of lateral arms and fixing bands, such that an end of the lateral arms is connected with the fixing bands to form an enclosed armband assembly, which is configured to be sleeved on the thigh of the body whilst exerting a compressing force for clamping and fixation. The lateral arm may be disposed on the front or rear side of the thigh, and the fixing bands may be fixed on the other side of the thigh correspondingly. The fixing band may be an elastic or non-elastic rope, or elastic or non-elastic band. During the use, the user may directly pass the thigh through an enclosed hollow area formed by the fixing band and the lateral arm until it is fastened to suitable part with the thigh, and may also perform the fixation on the leg in a binding or buckled manner.

The massaging assembly mounting bracket 1 is mounted on the leg clamping structure 2. The structure thereof may be a straight rod as shown in FIG. 1. A pair of lateral arms of the leg clamping structure 2 are vertically disposed at both ends of the massaging assembly mounting bracket 1, so that the massaging assembly mounting bracket 1 is positioned between both legs of the body when the leg clamping structure 2 clamps the legs of the body. In this way, when the leg performs a preset action, the massaging assembly mounted on the massaging assembly mounting bracket 1 may move with respect to the body along with the motion of the leg.

A plurality of mounting holes 1.1 (which also may be partially open bayonets) may be provided on the massaging assembly mounting bracket 1, and the lateral arms of the leg clamping structure 2 may be inserted into the corresponding mounting holes 1.1 as required, thereby adjusting a distance between the lateral arms. Further, by adjusting the positions of the front and rear lateral arms with respect to the massaging assembly mounting bracket 1, it is also possible to adjust the massaging position of various massaging assemblies with respect to the body. In addition to the adjustment structure of such discrete mounting holes, the body massaging device according to the present disclosure may also be provided in such a structure that the position of the leg clamping structure 2 is continuously adjustable with respect to the massaging assembly mounting bracket 1. For example, a sleeve or a slide block is provided on the lateral arms of the leg clamping structure 2, and the position adjustment is realized by unlocking and locking the sliding of t the sleeve or the slide block on the guide rail disposed on the massaging assembly mounting bracket 1.

The massaging assembly mounting bracket 1 is used for mounting various massaging assemblies. In addition to the anal massaging assembly described above, the massaging assembly here may also include a massaging assembly directed to a plurality of sexually sensitive parts such as the penis, the perineum, and the sphincter. These massaging assemblies used for massaging different sensitive parts may be arbitrarily selected and combined according to the needs. The specific forms and functions of these massaging assemblies will be described below, and will not be repeated for now. During the use of various massaging assemblies, it is optional to timely add lubricant to ensure adequate lubrication of the parts at which the massaging assemblies are in contact with the skin of the body.

Different forms of the anal massaging assembly are shown in FIGS. 4-9, and the anal massaging assembly includes an anal massaging arm 3 and an anal massaging head 4. The anal massaging arm 3 is mounted on the support holder. Specifically, the anal massaging arm 3 may be mounted on the massaging assembly mounting bracket 1, and may be fixed with respect to the massaging assembly mounting bracket 1, or rotatably connected or flexibly connected with the massaging assembly mounting bracket 1 according to the massaging function of the anal massaging head 4.

The anal massaging head 4 which is mounted at one end of the anal massaging arm 3, is configured to exert a compressing force to an anal part under the action of the anal massaging arm 3, so as to effectuate a compressing massage on the anus as well as the perianal skin, and is configured to perform a rubbing massage on the anus as well as the perianal skin by movement of the anal massaging head 4 on the anal massaging arm 3 or movement of the same along with movement of the anal massaging arm 3.

For the rotatable connection between the anal massaging arm 3 and the massaging assembly mounting bracket 1 in the support holder, referring to FIG. 1, a rotary shaft disk 3.1 may be provided on the massaging assembly mounting bracket 1, and the anal massaging arm 3 may be rotatably connected to the support holder through the rotary shaft disk 3.1. In order to enable the anal massaging head 4 to compress tightly the anus and the perianal skin, an elastic element is also provided between the anal massaging arm 3 and the massaging assembly mounting bracket 1.

Figure 11:
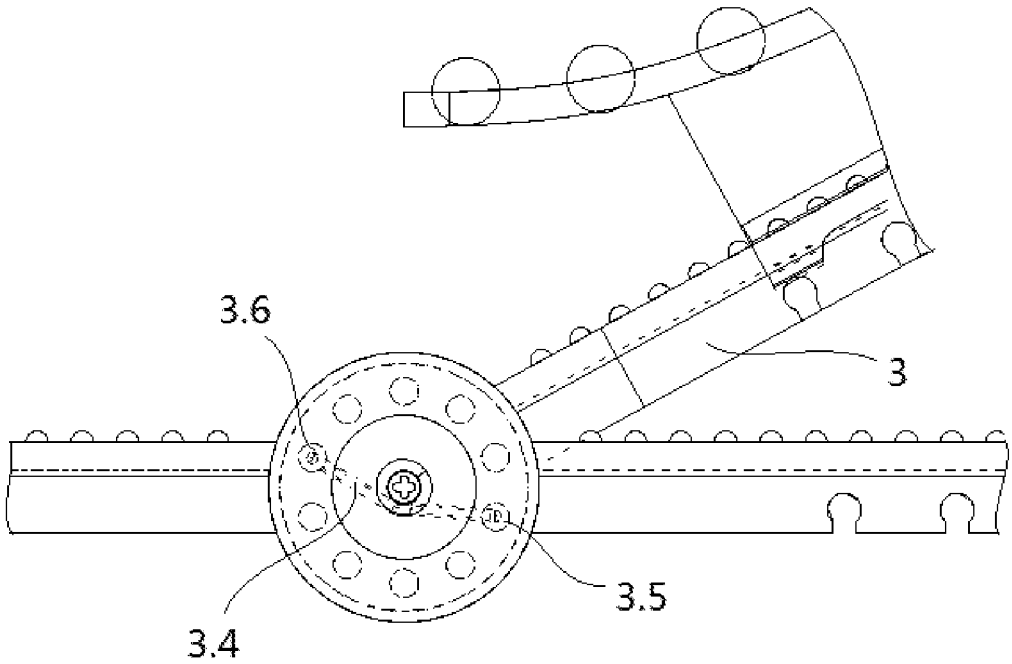
FIG. 11 is a schematic view of a mounting structure of an elastic element among an anal massaging arm, a rotary shaft disk, and a massaging assembly mounting bracket according to some embodiments of the body massaging device according to the present disclosure.

As shown in FIG. 11, the elastic element may use a torsion spring 3.4, which may be disposed inside the rotary shaft disk 3.1. The movable plate of the rotation shaft disk 3.1 is fixedly disposed with the anal massaging arm 3, and the stationary plate is fixedly disposed with the massaging assembly mounting bracket 1. The torsion spring 3.4 has one end connected in the torsion spring limit hole 3.5 of the stationary plate, and the other end connected in the torsion spring limit hole 3.6 of the movable plate. The elastic force of the elastic element may be adjusted so that the user obtains a compressing pressure that fits himself by adjusting the elastic force of the elastic element. As can be seen from the drawings, the rotary shaft disk 3.1 is provided with a plurality of torsion spring limit holes, so that both ends of the torsion spring 3.4 may be connected into different torsion spring limit holes on the stationary plate and the movable plate according to the needs of the preload, so as to provide different magnitudes of torsional forces.

Figure 12:
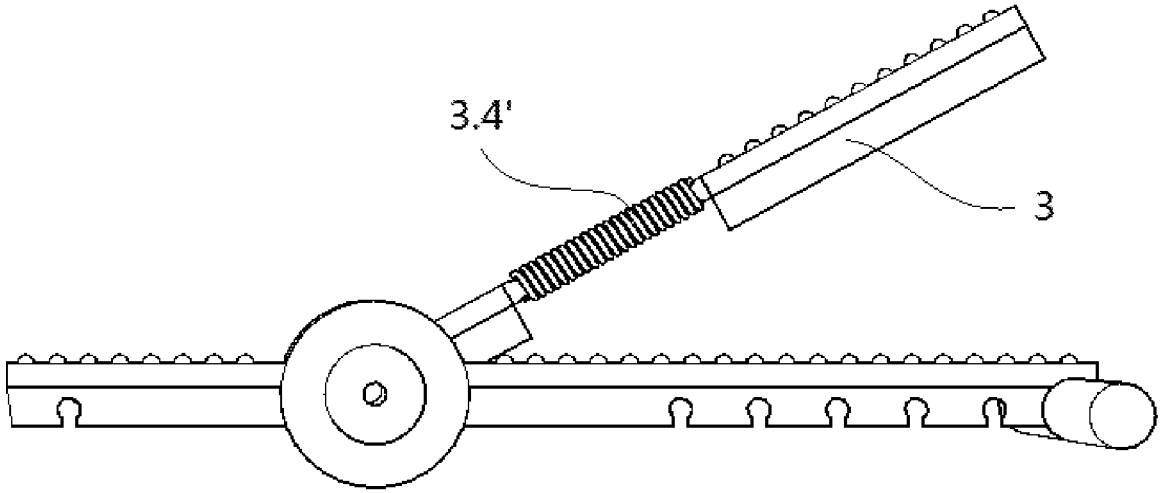
FIG. 12 is a schematic view of a mounting structure of another elastic element among an anal massaging arm, a rotary shaft disk, and a massaging assembly mounting bracket according to some embodiments of the body massaging device according to the present disclosure.

Under the effect of the elastic element, when the anal massaging arm 3 is swung backwards, a strong tension may be formed, so that the anal massaging arm 3 forms a rotary tendency toward the anus, thereby causing the anal massaging head 4 to compress tightly the anus and the perianal skin. In other embodiments, the elastic element may also be in the form of a spring, an elastic sheet, or the like. For example, the elastic element shown in FIG. 12 is a spring 3.4', which is provided between the rotary shaft disk 3.1 and the anal massaging arm 3 and configured to provid a preload to the part at which the anal massaging arm 3 abuts against the anus. In another application form of the spring, the spring may also be disposed between the middle of the anal massaging arm 3 and the massaging device mounting bracket 1 of the support holder.

Figure 3:
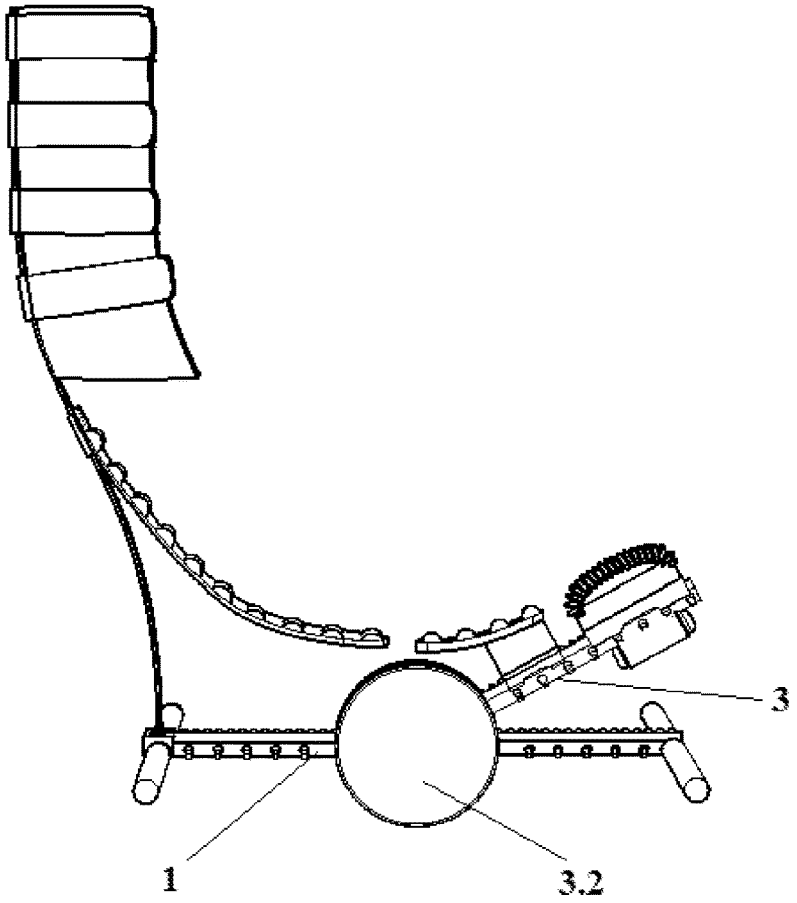
FIG. 3 is a schematic structural view of a protective housing provided in some embodiments of the body massaging device according to the present disclosure.

Considering that there is a relative rotation between the anal massaging arm 3 and the massaging assembly mounting bracket 1, in order to prevent these parts in relative movement from injuring the skin of the body by compression during the movement, a protective housing 3.2 is also selectively provided on the outer side of the rotary shaft disk 3.1 (specifically see FIG. 3). The protective housing 3.2 can isolate the body from the rotary shaft disk 3.1, so as to avoid possible damage caused to the body during the movement of the rotary shaft disk 3.1.

Figure 4:
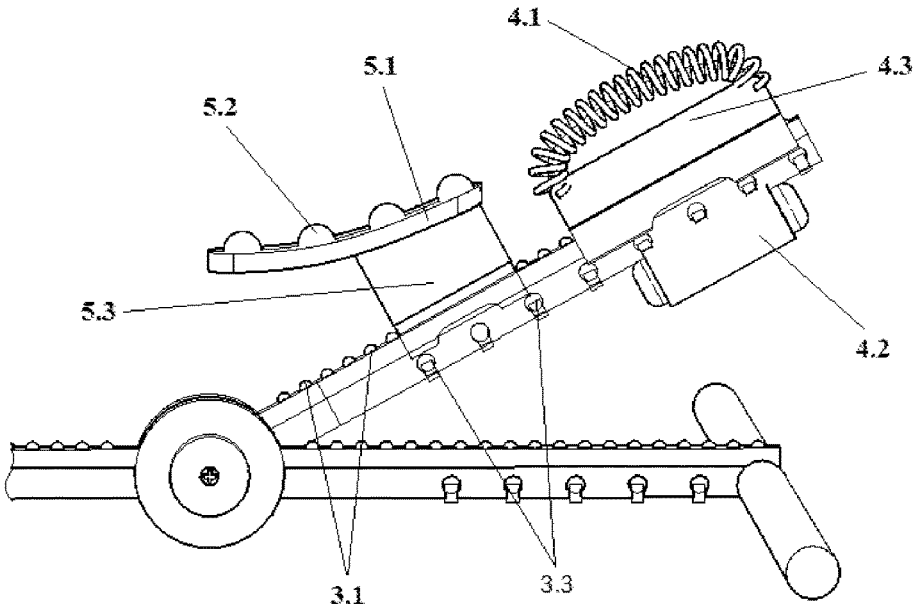
FIG. 4 is a schematic structural view of an anal massaging head in variable shapes and a perineum massaging head mounted on a posterior anal massaging arm according to some embodiments of the body massaging device according to the present disclosure.
Figure 5:
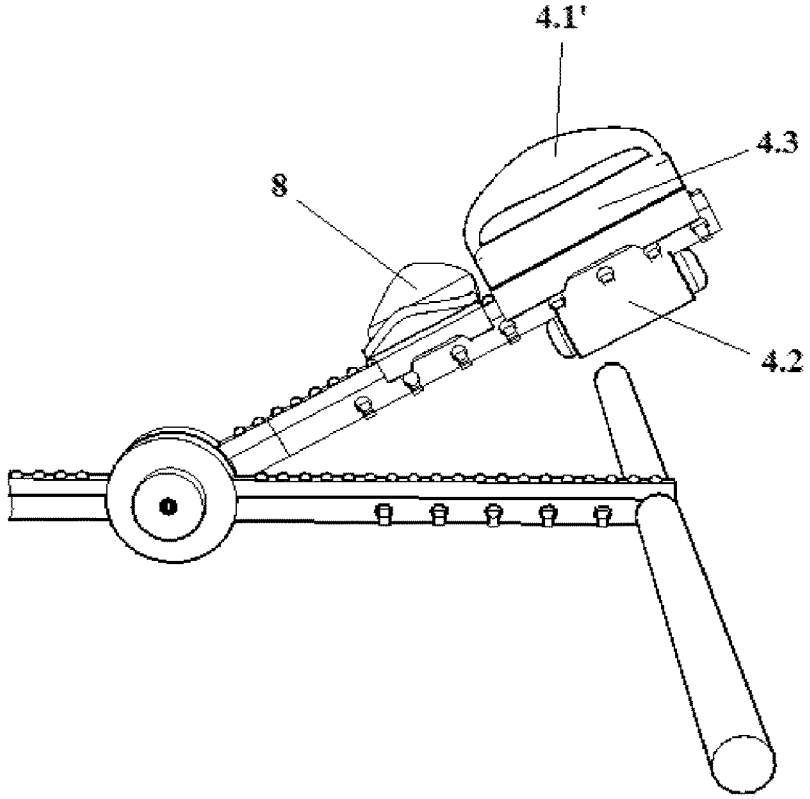
FIG. 5 is a schematic structural view of an anal massaging head and a sphincter massaging head with smooth surfaces mounted on a posterior anal massaging arm according to some embodiments of the body massaging device according to the present disclosure.
Figure 6:
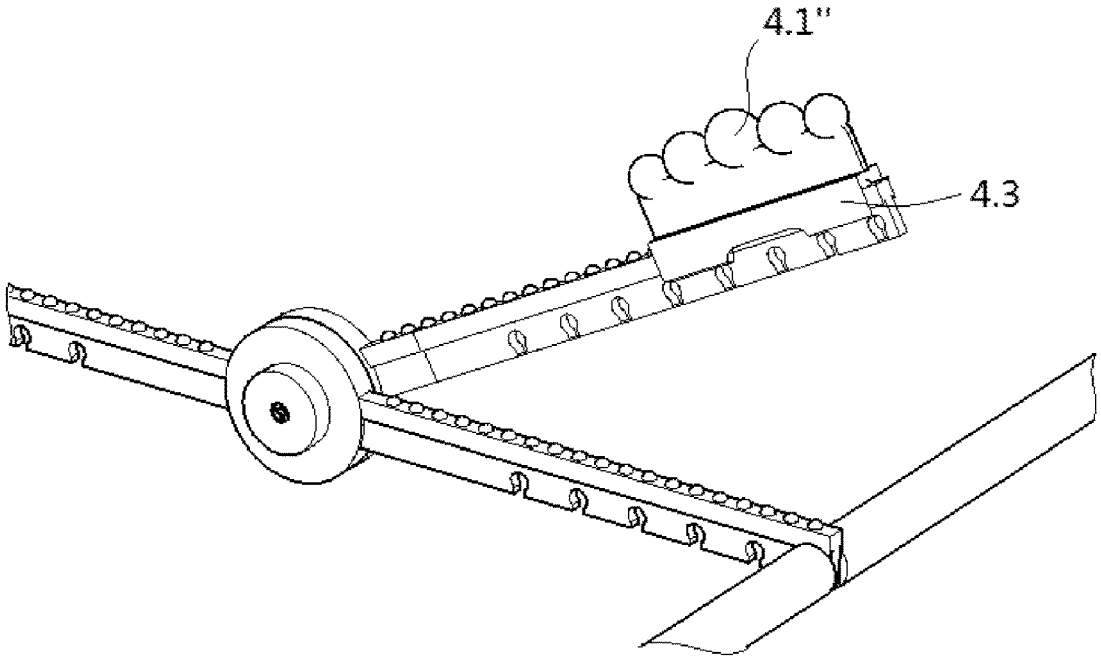
FIG. 6 is a schematic structural view of an anal massaging head with a concave-convex surface mounted on a posterior anal massaging arm according to some embodiments of the body massaging device according to the present disclosure.
Figure 7:
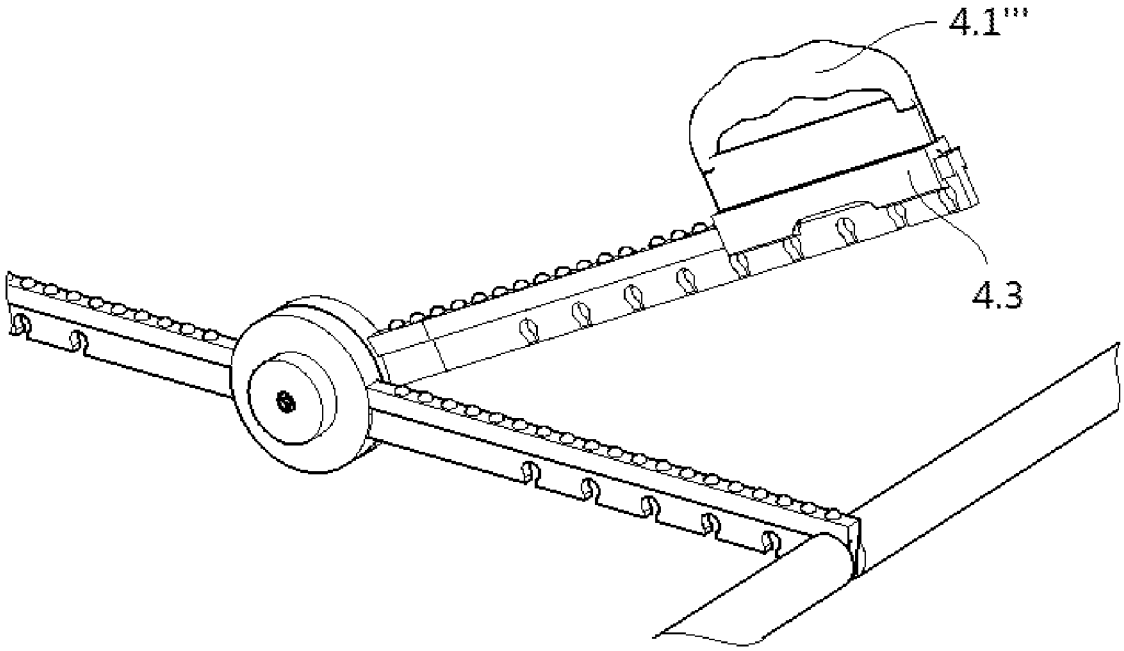
FIG. 7 is a schematic structural view of an anal massaging head with a corrugated surface mounted on a posterior anal massaging arm according to some embodiments of the body massaging device according to the present disclosure.
Figure 8:
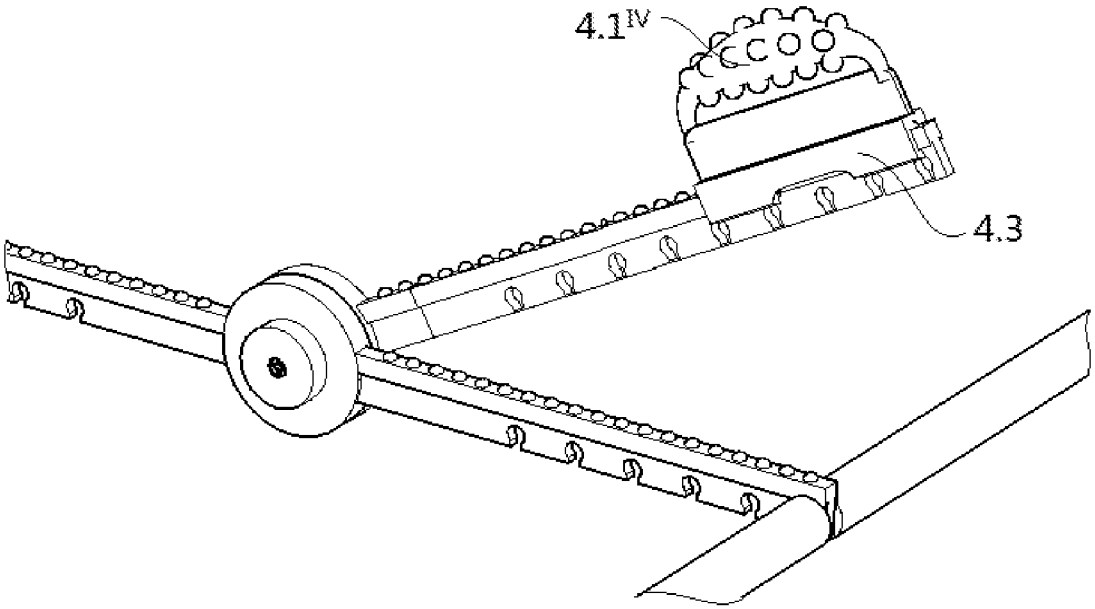
FIG. 8 is a schematic structural view of an anal massaging head with a granular surface mounted on a posterior anal massaging arm according to some embodiments of the body massaging device according to the present disclosure.
Figure 9:
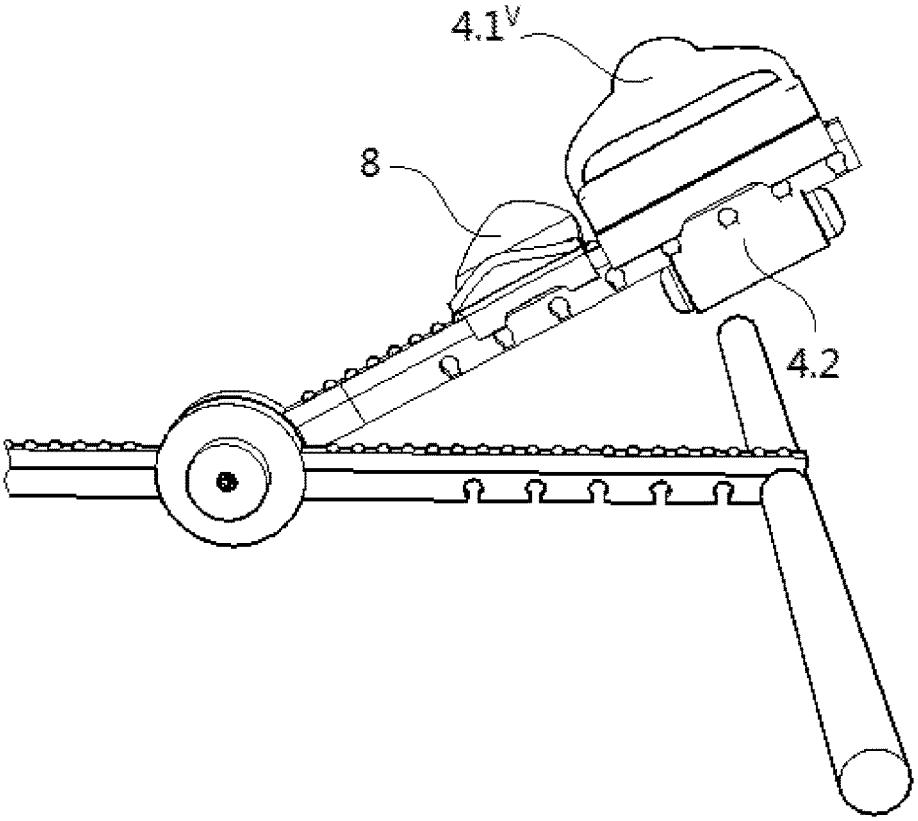
FIG. 9 is a schematic structural view of an anal massaging head with a circular protrusion mounted on a posterior anal massaging arm according to some embodiments of the body massaging device according to the present disclosure.

FIGS. 4 and 5 show different forms of anal massaging heads 4, and the user may change a desired form of anal massaging head 4. That is, the anal massaging head 4 is detachable and/or replaceable with respect to the anal massaging arm 3. Moreover, the anal massaging head 4 may also be adjustable in position with respect to the anal massaging arm 3, so that the user may make an adjustment according to the comfort or the massaging area. A plurality of mounting holes 3.3 may be provided in the anal massaging arm 3, and the anal massaging head 4 may adjust the position of the anal massaging head 4 with respect to the anal massaging arm 3 by mounting the anal massaging head 4 in different mounting holes 3.3. In addition to the adjustment structure of such discrete mounting holes, in further embodiments of the body massaging device according to the present disclosure, it may also be provided in such a structure that the position of the anal massaging head 4 is continuously adjustable with respect to the anal massaging arm 3. For example, a sleeve or a slide block is provided on the anal massaging head 4, and the position adjustment is realized by unlocking and locking the sliding of the sleeve or the slide block on the anal massaging arm 3.

In order to enhance the massaging effect, in some embodiments, a vibration motor 4.2 may be provided on the anal massaging arm 3 or on the anal massaging head 4, and the vibration effect produced by the vibration motor 4.2 is used to prompt the anal massaging head 4 to produce a continuous vibration effect over the anus and the perianal skin. In combination with the compressing and/or rubbing effect realized by the anal massaging head, the sexually stimulation effect of the body may be further improved. The vibration motor 4.2 may be adjusted in position on the anal massaging arm 3, together with the anal massaging head 4.

The anal massaging head 4 may be integrally made of a single material such as metal, rubber, silicone, plastic, ceramics, and the like, and may also be a combination of multiple materials. Considering the durability and operational comfort of the anal massaging head 4, it allows using a form of anal massaging head 4 including a base body and a flexible surface layer material, wherein the flexible surface layer material is covered on at least a partial surface of the base body. The flexible surface layer material which may be silicone, rubber or leather, can improve the comfort during the use, and avoid possible harm caused to the anal part and the perianal skin in the massaging process as much as possible.

A portion of the anal massaging head 4 for contacting the anus and the perianal skin may be configured to be a smooth surface, a corrugated surface, a granular surface, a concave-convex surface or a surface with an adjustable shape. The anal massaging head 4 shown in FIG. 4 has a mount 4.3 and a spiral wire 4.1 which is mounted on the mount 4.3 and used for contact with the anus and the perianal skin. The spiral wire 4.1 can be manually adjusted into various shapes, for example integrally in an arc shape or a wave shape. The spiral wire 4.1 may have multiple sets of spirals to form a tinier wave shape, so as to enable that a more delicate massaging feeling is produced to the body. The anal massaging head 4 shown in FIG. 5 has a mount 4.3 and a hard rod 4.1' which is mounted on the mount 4.3 and used for contact with the anus and the perianal skin. The hard rod 4.1' may be machined into a smooth surface. And it is also possible to machine a plurality of discrete concave-convex structures in a longitudinal direction, a transverse direction or spiral shapes on a surface of the hard rod 4.1'. The hard rod 4.1' may also serve as a base body, which may be further provided with a flexible surface layer material such as rubber, silicone, nylon, leather and the like thereon.

Other forms of anal massaging heads 4 are shown in FIGS. 6-9. Among them, a plurality of hard or flexible protrusions 4.1" are mounted on the mount 4.3 of FIG. 6 to form a concave-convex surface. A hard or flexible rod 4.1''' presenting a wave shape along a longitudinal direction is mounted on the mount 4.3 of FIG. 7. A plurality of granular protrusions $\mathbf{4.1}^{IV}$ dispersed along a longitudinal direction and a transverse direction are mounted on the mount 4.3 of FIG. 8. A hard rod $\mathbf{4.1}^{V}$ provided with circular or elliptical protrusions mated with the shape of the anal orifice is mounted on the mount 4.3 in FIG. 9, and may enhance the massaging effect on the anal orifice. These different forms of anal massaging heads 4 provide the user with more options to meet different needs of the user.

In further embodiments, the anal massaging arm 3 may specifically include a telescopic rod and a telescopic drive mechanism. An end of the telescopic rod is connected with the anal massaging head 4. The drive telescopic rod can be driven to perform a telescopic action by a telescopic drive mechanism, so that the anal massaging head 4 exerts a sliding stimulus to the anus and the perianal skin. Under the control of the user, the telescopic drive mechanism may automatically exert a sliding stimulus on the anus and the perianal skin of the user, so that the problem that the user is prone to fatigue during long-term use can be eliminated. The telescopic drive mechanism may realize a stronger driving force to strengthen the massaging effect. The telescopic drive mechanism may directly drive the the telescopic rod using a linear air cylinder, a linear hydraulic cylinder, or a linear electric motor. The telescopic rod may also use a pneumatic motor, a hydraulic motor, or a motor in conjunction with a transmission mechanism to achieve linear drive of the telescopic rod.

In addition to the anus and the perianal skin that are very sensitive on the body, such parts as the penis, the anal sphincter, the perineum, and the like are also very sensitive. Therefore, the body massaging device according to the present disclosure may also be further provided with massaging assemblies directed to such parts as the penis, the anal sphincter, the prostate, and the perineum.

Figure 10:
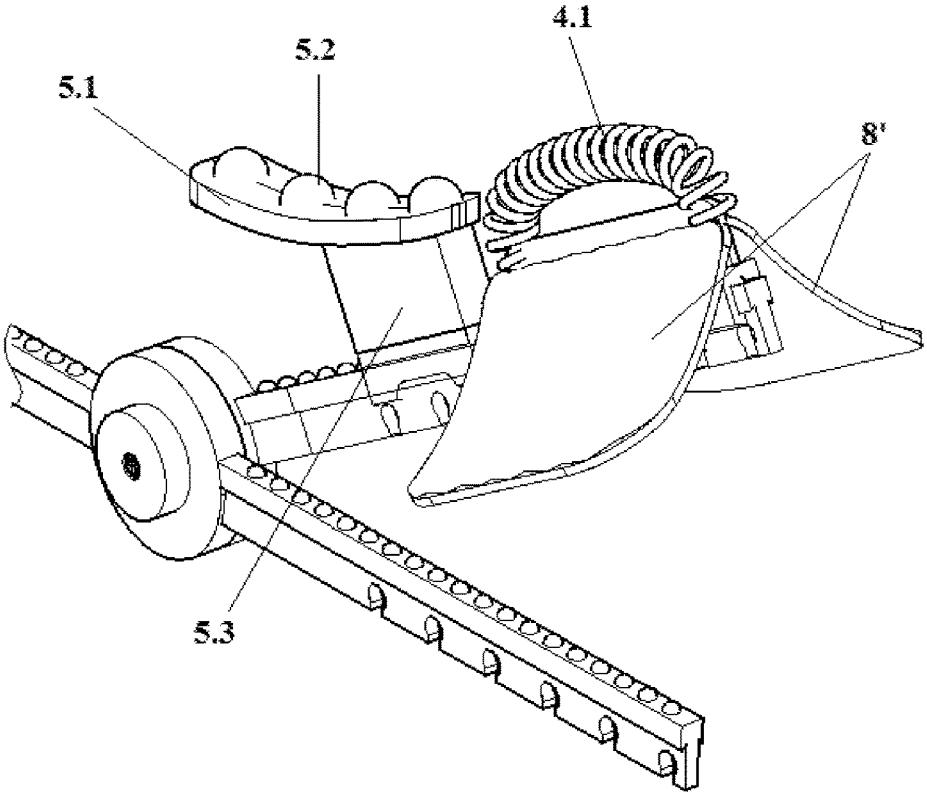
FIG. 10 is a schematic structural view of an anal massaging head in variable shapes, a perineum massaging head, and a sphincter massaging head mounted on a posterior anal massaging arm according to some embodiments of the body massaging device according to the present disclosure.
Figure 13:
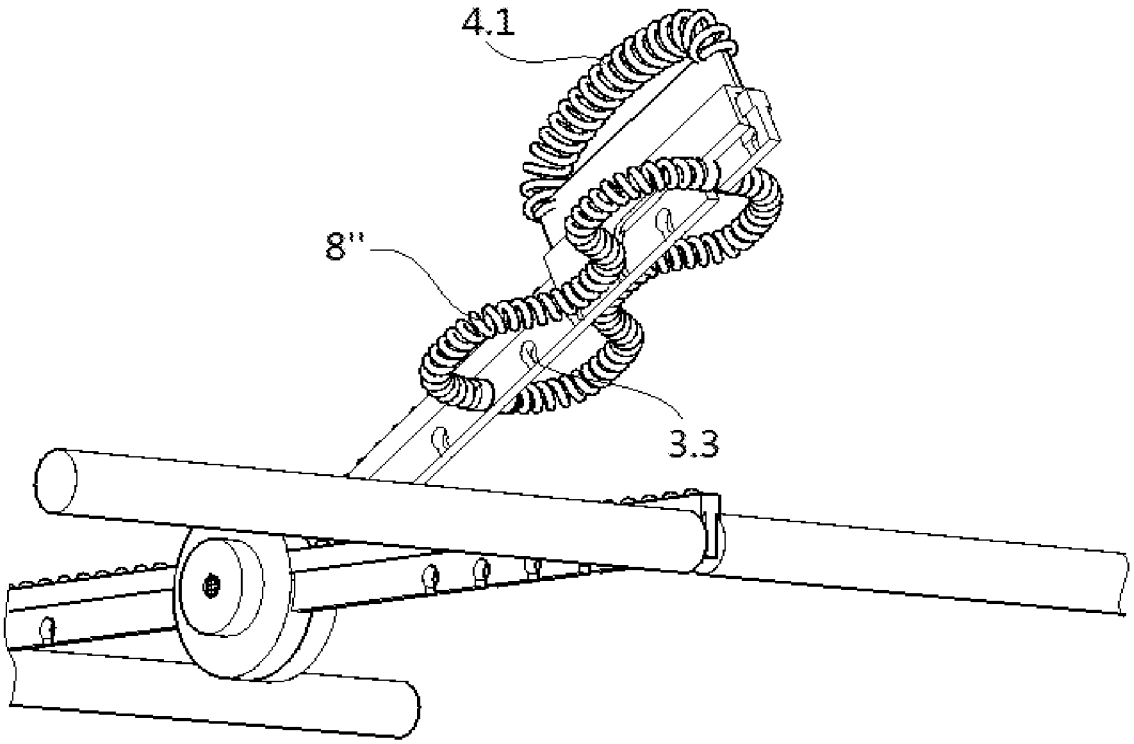
FIG. 13 is a schematic structural view of an anal massaging head in variable shapes, and a sphincter massaging head in variable shapes mounted on a posterior anal massaging arm according to some embodiments of the body massaging device according to the present disclosure.

In further embodiments of the body massaging device according to the present disclosure, a sphincter massaging head for performing a compressing and/or rubbing massage on the anal sphincter may also be included. FIGS. 5, 10 and 13 respectively show three different forms of sphincter massaging heads 8, 8' and 8". The sphincter massaging head may be mounted directly on the support holder, and may also be mounted on other massaging assemblies. For example, it is mounted on the anal massaging arm 3 in the anal massaging assembly.

In order to facilitate mounting the sphincter massaging head, a sphincter massaging arm for mounting a sphincter massaging head may be selectively provided. That is, the sphincter massaging head may be mounted on the support holder through the sphincter massaging arm, or mounted to other massaging assemblies (for example, the anal massaging assembly and the like). The sphincter massaging head may be provided in the plural and mounted in different positions, for example the left and right sides or the front and rear sides of the anal massaging assembly, so as to massage the anal sphincter in different positions, thereby obtaining a more comfortable massaging feeling.

The sphincter massaging head 8 shown in FIG. 5 which is directly mounted on the anal massaging arm 3, and located on the front side of the anal massaging head 4, can perform a compressing and/or rubbing massage on the anal sphincter at a front side of the anus. The sphincter massaging head 8' shown in FIG. 10 which is directly mounted at the left and right sides of the anal massaging head 4, can perform a compressing and/or rubbing massage on the anal sphincter at the left and right sides of the anus. The sphincter massaging head 8' in FIG. 10 with a relatively wide size may match the contour of the buttocks. The sphincter massaging head 8" in FIG. 13 is also directly mounted on the anal massaging arm 3 in the form of a spiral wire that can be manually adjusted into various shapes, for example, integrally presenting an arc shape or a wave shape. The spiral wire 4.1 has multiple sets of spirals to form a tinier wave shape, so as to enable that a more delicate massaging feeling is produced to the body. The sphincter massaging head 8" with such spiral wire structure may be mounted and adjusted in position using the mounting hole 3.3 in the anal massaging arm 3.

The sphincter massaging head may be fixed on such as the support holder or other massaging assemblies, and may also be detachable and replaceable with respect to the sphincter massaging arm, the anal massaging assembly, and/or the support holder. Moreover, the setting position of the sphincter massaging head may be adjusted according to the needs of the user. It can also be allowed that the sphincter massaging head slides with respect to the support holder or other massaging assemblies (e.g., the anal massaging assembly and the like) by the drive mechanism provided, so as to realize a sliding massage on the anal sphincter and the surface skin thereof. The drive mechanism may automatically apply a sliding stimulus to the anal sphincter of the user. Such devices as a vibration motor to realize the vibration may also be provided on the sphincter massaging head.

A portion of the sphincter massaging head for contacting the anal sphincter may be configured to be a smooth surface, a corrugated surface, a granular surface, a concave-and-convex surface or a surface with an adjustable shape, so as to satisfy the operational needs of the user. The sphincter massaging head may be formed of a single material. The sphincter massaging head may also include a base body and a flexible surface material covered on at least a partial surface of the base body. The flexible material or the flexible surface layer material can improve the comfort during the use, and avoid possible harm caused to the anal sphincter and the surface skin thereof in the massaging process as much as possible.

In further embodiments of the body massaging device according to the present disclosure, a penis massaging assembly may be further added. The penis massaging assembly may be mounted on the massaging assembly mounting bracket 1 or the leg clamping structure 2 of the support holder, for performing a compressing and/or rubbing massage on the penis of the body.

Since the sexual nerves around the urethral orifice of the penis and around the anal orifice are most developed, such nerves exert a greatest effect over sexual pleasure and orgasm. Therefore, sexual pleasure and orgasm may be effectively produced by effectuating simultaneous sliding and compressing stimulation of the penis, the anus and the perianal skin. Among them, the penile pleasure is the main manner for the male to obtain sexual pleasure and orgasm during sexual intercourse with a mate, while the sexual nerves around the anus which are close to the prostate mainly brings the pleasure of the prostate for the stimulation around the anus, and such pleasure is different from the experience and feeling produced to the body by the penile pleasure. Further, by the massaging effect of the anal massaging assembly and the penis massaging assembly mounted on the support holder according to the present embodiments, it is possible to subject the body to the stimulation of the penis and the stimulation of the anus and the perianal skin, even the prostate at the same time, so that the male user can experience an extraordinary experience and a marvelous feeling after two sexual pleasures are juxtaposed in addition to a normal sexual intercourse process. Moreover, the user may control the stimulation intensity at different parts according to own conditions, so as to effectively delay the ejaculation time, thereby to keep the user in a high degree of sexual excitement and orgasm for a long time.

Referring to FIGS. 1 and 2, the penis massaging assembly includes a penis massaging arm 7 and a penis massaging head 6. Among them, the penis massaging arm 7 is mounted on the support holder, and the penis massaging head 6 is mounted at one end of the penis massaging arm 7 and configured to exert a compressive force to the penis so as to effectuate a compressing massage on the penis, and performing a rubbing massage on the penis along with movement of the penis with respect to the penis massaging head 6.

The penis massaging arm 7 may be mounted on the massaging assembly mounting bracket 1 or the leg clamping structure 2 of the support holder, at a position which is located anterior to the anal massaging assembly. The penis massaging arm 7 may also be removed from the support holder, in such a form that it may also be provided to be rotatably connected or flexibly connected with the support holder, so as to adjust the inclination angle and position of the penis massaging head 6. The penis massaging head 6 may be fixedly mounted on the penis massaging arm 7, and may also be detachable and/or replaceable with respect to the penis massaging arm 7. The position of the penis massaging head 6 on the penis massaging arm 7 may be adjusted as needed.

With reference to FIGS. 1 and 2, one example of the penis massaging head 6 includes a plurality of at least partially enclosed annular structures 6.1 arranged along a length direction of the penis massaging arm 7, and a hollow portion of the annular structure 6.1 is used for receiving the penis. The annular structure 6.1 may selectively be rearwardly open, so that the user can place the penis forward into the annular structure 6.1. For an annular structure 6.1 fully enclosed in a circumferential direction, the user may place the penis upwardly into the annular structure 6.1 from the lower side of the annular structure 6.1.

The annular structure 6.1 may be an elastic structure, and may also be made of an elastic material. Alternatively, an inner wall of the annular structure 6.1 is an elastic structure or is made of an elastic material. The inner wall of the annular structure 6.1 may be configured in a contour shape that substantially matches an outer contour of the penis so as to adapt to different sizes and shapes of penises. The size and material of the plurality of annular structures 6.1 may be the same, and may also be different. Each annular structure 6.1 may be individually replaced, so as to be combined into an internal contour more suitable for the user. In other embodiments, the annular structure 6.1 or the inner wall of the annular structure 6.1 may also be made of a non-elastic material.

In other embodiments, the penis massaging head 6 may specifically include an at least partially enclosed tubular structure provided along a length direction of the penis massaging arm 7. The tubular structure may selectively be rearwardly open, so that the user can place the penis forward into the tubular structure. For a tubular structure fully enclosed in a circumferential direction, the user may place the penis upwardly into the tubular structure from the lower side of the tubular structure. The tubular structure may be an elastic structure, and may also be made of an elastic material. Alternatively, the inner wall of the tubular structure is an elastic structure or is made of an elastic material. The inner wall of the tubular structure may be configured in a contour shape that substantially matches an outer contour of the penis so as to adapt to different sizes and shapes of penises. In other embodiments, the tubular structure or the inner wall of the tubular structure may also be made of a non-elastic material.

In order to allow the penis to obtain a proper stimulation effect, the tubular structure or the annular structure 6.1 is alternatively lined with a flexible massaging cushion 6.2, wherein an inner surface of the flexible massaging cushion in contact with the penis is configured to be a smooth surface, a corrugated surface, a granular surface, or a concave-convex surface. The user can obtain a more comfortable operational feeling by different shapes of surfaces.

The flexible massaging cushion 6.2 may include a flexible surface layer and a flexible filler, in which the flexible filler is disposed between the flexible surface layer and an inner wall of the tubular structure or the annular structure 6.1, so as to avoid that the penis is injured in the massaging process.

A perineum massaging assembly may also be further provided on the penis massaging assembly for performing a compressing and/or rubbing massage on the perineum (including a inner part of the thigh root) proximate to the root position of the penis. FIG. 1 shows a perineum massaging assembly 5 mounted on the penis massaging arm 7. The perineum massaging assembly 5 may also be disposed on the anal massaging assembly. Another perineum massaging assembly 5 shown in FIG. 1 which is mounted on the anal massaging arm 3, can perform a compressing and/or rubbing massage on the perineum at a front side of the anus. In further embodiments, the perineum massaging assembly 5 may also be mounted directly on the support holder.

The perineum massaging assembly may only include the perineum massaging head 5.1, or may be selectively mounted by the perineum massaging arm 5.3 depending on the set position. Considering that the perineum of the body is located at a strip area from the root of the penis to the front side of the anus, and moreover, the area presents a certain curve, it is necessary that the perineum massaging arm 5.3 and/or the perineum massaging head 5.1 can be flexible into different angles or shapes, so that the perineum massaging head 5.1 matches with the perineum in different forms.

It can be seen from FIG. 1 that the perineum massaging head 5.1 integrally presents a circular arc shape projecting towards a front lower portion, which shape matches the curve of the perineum area of the body, so as to obtain a better closely attached effect. As can also be seen from FIG. 1, a portion of the perineum massaging head 5.1 for contacting the perineum region is provided with a plurality of granular protrusions 5.2 to form a granular surface, which may enhance the massaging and compressing effect on the perineum. In further embodiments, a portion of the perineum massaging head 5.1 for contacting the perineum may also be configured to be a smooth surface, a corrugated surface or a concave-convex surface.

The perineum massaging head 5.1 may be integrally made of a single material. For example a silicone, plastic, metallic or nylon material presenting certain elasticity is used to make the perineum massaging head 5.1. According to different materials used, the perineum massaging head 5.1 may also be bent into a desired radian as needed. In other embodiments, the perineum massaging head 5.1 may include a base body and a flexible surface material covered on at least a partial surface of the base body. In this way, the supporting effect may be realized by the base body. Moreover, the flexible surface layer material may improve the comfort during the use, and avoid possible harm caused to the perineum in the massaging process as much as possible.

In order to facilitate selecting a massaging part by the user according to the requirements, the perineum massaging head 5.1 may be detachable, with respect to the perineum massaging arm 5.3, the support holder, the anal massaging assembly and/or the penis massaging assembly directly mounted thereby. The user may also substitute an appropriate perineum massaging head 5.1 as needed, and adjust the position of the perineum massaging head 5.1.

In addition to the above-mentioned various massaging assemblies directed to the surface layer skin, the massaging assembly mounting bracket of the support holder according to the present disclosure may also mount an insertion-type massaging assembly, such as an insertion-type prostate massager. The insertion-type prostate massager may be directly mounted on the anal massaging arm, and may also be directly mounted on the support holder, or mounted on the support holder by means of the anal massaging arm. The function thereof is for inserting into the anus of the body to perform a compressing and/or rubbing massage on the prostate interior to the anus, so as to realize the stimulation effect over the prostate of the body.

When the aforementioned embodiments of the body massaging device are used, it is necessary to mount the support holder on a lower limb of the body. In order to make its fixation more reliable, it may be further assisted by wearing a bearing garment. The user needs to wear the bearing garment at least at the leg and waist-hip parts of the body, and the bearing garment can bear the support holder, to assist in fixing the support holder on a lower limb of the body. The bearing garment also at least partially wrapping the support holder and various massaging assemblies mounted on the support holder, so as to assist various massaging assemblies to approach corresponding positions of the body. The bearing garment may be made of a non-elastic material, and may also be made of an elastic material.

Figure 14:
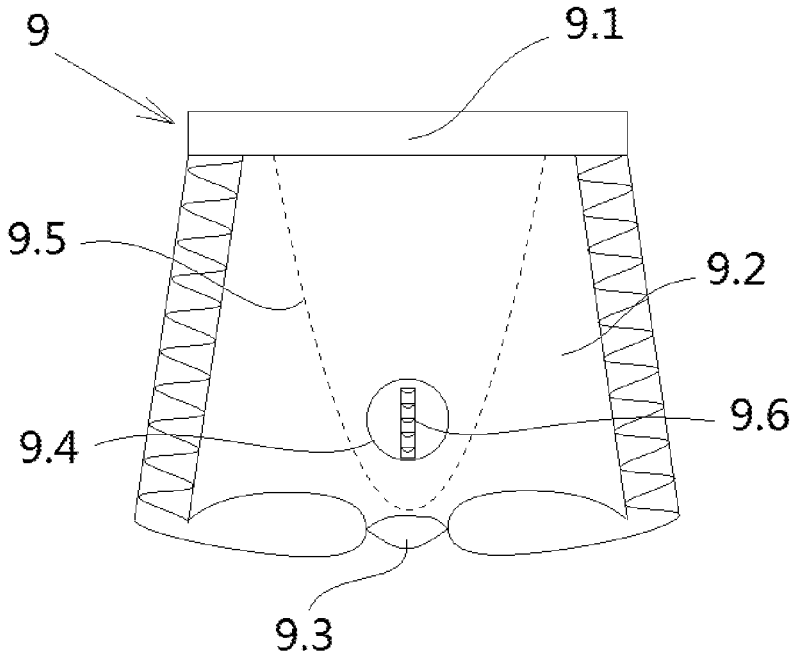
FIG. 14 is a schematic structural view of a bearing garment according to some embodiments of the body massaging device according to the present disclosure.

As shown in FIG. 14, the bearing garment may be a bearing shorts 9. An upper side of the bearing shorts 9 is provided with waist-hip wrapping portion 9.1 which has a waist belt, a pulling rope or an elastic rope capable of adjusting a wrapped size of the waist-hip portion. The lower side of the bearing shorts 9 is provided with leg wrapping portions 9.2 wrapping the thighs of the body. A crotch wrapping portion may be provided between the leg wrapping portions 9.2 at both sides, such that the waist-hip wrapping portion 9.1, the leg wrapping portions 9.2 and the crotch wrapping portion jointly bear the support holder, and can also jointly wrap the support holder and various massaging assemblies on the support holder.

Considering that lubricant is usually used for the body in the massaging process, and the body itself may secrete certain amount of body fluid, when the lubricant and the body fluid flow to the legs, it may cause discomfort to the user, and thus a liquid collection bag 9.3 may be selectively provided at the crotch wrapping portion. As it is at a lower position, it is possible to collect the lubricant and the body fluid secreted by the body in the massaging process, and isolate the lubricant and the body fluid from the body, thereby facilitating cleaning up by the user, and also making the user more comfortable during long-term use.

In order to assist in the fixation of the support holder, a vest band 9.5 may be further mounted on the waist-hip wrapping portion 9.1. The vest band 9.5 is connected to the support holder and various massaging assemblies mounted on the support holder, to assist in a bearing effect of the bearing shorts 9. The connection form thereof may be that the vest band 9.5 is fastened on the support holder, or passed through the mounting hole on the support holder or passed below the support holder, so as to achieve an effective supporting effect over the support holder.

Figure 15:
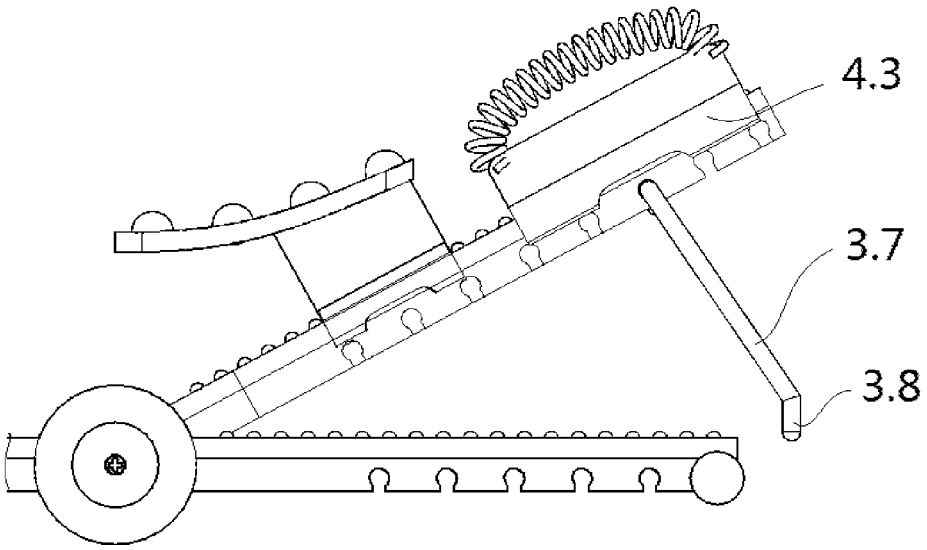
FIG. 15 is a schematic view of a mounting structure provided with a support rod on the anal massaging head according to some embodiments of the body massaging device according to the present disclosure.

In order to enable the anal massaging head to provide a suitable compressing force to the anus and the perianal skin, a support rod 3.7 may be further mounted on the anal massaging head 4 in the anal massaging assembly shown in FIG. 15. The support rod 3.7 can be supported at a rear side of the bearing shorts 9, so that the anal massaging head 4 abuts against the anus and the perianal skin by a bearing effect of the bearing shorts 9 and the support rod 3.7. It can be seen from FIG. 15 that the upper end of the support rod 3.7 which is hinged on the lower side of the mount 4.3 of the anal massaging head 4, can swing with respect to the mount 4.3. After the supporting rod 3.7 is fixed by the rear side of the bearing shorts 9, the pressure exerted by the bearing shorts 9 to the supporting rod 3.7 may be transferred to the anal massaging head 4, so that it abuts against the anus and the perianal skin, thereby obtaining a better compressing and rubbing massage effect. In other embodiments, the support rod 3.7 may also be mounted on the anal massaging arm 3.

The support rod 3.7 may be directly supported to the rear side of the bearing shorts 9. For example, the free end of the support bar 3.7 is formed into a support plane with a large contact area, so that the support rod 3.7 can be supported within the bearing shorts 9 as stably as possible. In order to make the support of the support rod 3.7 more stable, and satisfy the adjustment requirements, a plug 3.8 is selectively provided at an end of the support rod 3.7, and a supporting and fixing portion 9.6 is provided at a rear side of the bearing shorts 9. The supporting and fixing portion 9.6 (see FIG. 14) is provided with a plurality of plug fixing holes which are matable with the plug 3.8, and the plug 3.8 can be selectively plugged into any one of the plug fixing holes, so as to effectuate adjusting a fixed position of the support rod 3.7. The plug fixing holes may be discretely arranged in the plural along a vertical direction. When the user feels an excessive compressing force of the anal massaging head 4, the plug 3.8 may be inserted into the lower plug fixing hole, and in the other way around, the plug 3.8 is inserted into the upper plug fixing hole.

As the penis massaging assembly mentioned above is detachable, when the penis massaging assembly is in a detached state, the opening 9.4 provided on a front side of the bearing shorts 9 may facilitate the penis of the body in protruding from the opening 9.4, so that the user may perform sexual intercourse with a mate while wearing the body massaging device. In the process of sexual intercourse, along with a back-and-forth motion of the body of the male user in the process of sexual intercourse, the body can also be subjected to a sliding and/or compressing stimulation at such parts as the anus and the perianal skin, the anal sphincter, the perineum, and the like while the penis is subjected to a sliding stimulation. Accordingly, it is possible to enhance the erectile hardness of the penis and promote the intensity of sexual pleasure and orgasm of the user and the mate.

In further embodiments, the body massaging device may further include an insertion-type prostate massager mounted on the anal massaging assembly and/or the support holder directly or by means of the anal massaging arm, for inserting into the anus to perform a compressing and/or rubbing massage on a prostate interior to the anus.

In the embodiments of each of the body massaging devices as mentioned above, there may be further provided with an electric, pneumatic or hydraulic driving mechanism for driving various massaging assemblies mounted on the massaging assembly mounting bracket 1 to realize automatic massage. The user may control the stimulation intensity by controlling the driving mechanism, and may effectively save the physical strength and eliminate the problem of fatigue during long-term use.

A plurality of embodiments the body massaging device according to the present disclosure have been described in detail below with reference to the accompanying drawings. It should be noted that, for the anal massaging assembly, in order to obtain a better massaging effect over the anus and the perianal skin, it is usually necessary to form a compressing effect that is no less than a predetermined compressing force over the anus and the perianal skin. By means of the compressing effect, it is also possible to increase a friction force required for a rubbing massage, thereby forming a more intense stimulation effect over the anus and the perianal skin. One or a combination of a plurality of the elastic element, the bearing shorts, the support rod, as well as the vest band and the plug fixing holes provided within the bearing shorts is a structure capable of ensuring a compressing force of the anal massaging head.

The body massaging device mounted with various massaging assemblies in the present disclosure not only can provide the user with a specially experienced sexual stimulation and orgasm to meet the sexual entertainment needs of the user, but also can adjust the physical state of the user, assist in rehabilitation of the user himself concerning urinary, anorectal, reproductive, and digestive system diseases and promote the sexual ability of the user by a massaging effect over the skin, muscles, and acupoints of the massaging parts, so as to satisfy the sexual health care of the user as well as the adjuvant therapy of related diseases. The body massaging device according to the present disclosure which may be directed to different needs of the user, becomes a sexual massaging device for realizing health care of the sexual function, an adjuvant therapy device for realizing adjuvant rehabilitation from diseases and improvement of the sexual ability, or a sexual entertainment device for effectuating promoting the sexual interest.

Based on the plurality of embodiments of the body massaging device mentioned above, the operation method thereof will be described next. The method for operating the body massaging device includes:

mounting the support holder on a lower limb of a body, and making the anal massaging assembly abut against a position of an anus of the body; and making the anal massaging assembly perform a compressing and/or rubbing massage on the anus and the perianal skin of the body by predetermined repetitive actions performed by the body.

The predetermined repetitive action here may be a repeated flexion and extension action of a waist or a knee in a standing state of the body. For example, the body repeatedly and alternately performs bowing and erecting actions at a slight degree, or repeatedly and alternately performs squatting and erecting actions at a slight degree, such that the crotch of the body can move with respect to the anal massaging assembly, thereby effectuating that the anal massaging assembly performs a compressing and/or rubbing massage on the anus and the perianal skin of the body. Similarly, for the perineum massaging assembly, the sphincter massaging assembly and the penis massaging assembly, such preset repetitive action may also realize a relative movement between such massaged parts and the massaging assembly, thereby effectuating that the massaging assembly performs a compressing and/or rubbing massage on the corresponding massaging parts. In addition, the preset repetitive action also includes a walking action of the body in small steps and an intercourse action with a mate.

The support holder mentioned earlier may specifically include: a leg clamping structure 2 for clamping and fixing a leg of the body and a massaging assembly mounting bracket 1 mounted on the leg clamping structure 2 and used for mounting various massaging assemblies. In some embodiments, the operation method may accordingly further include:

making the various massaging assemblies mounted on the massaging assembly mounting bracket 1 abut against corresponding positions of the body when the support holder is mounted on the leg of the body; and making the various massaging assemblies perform a compressing and/or rubbing massage on corresponding positions of the body when the body performs a predetermined repetitive action.

In part of the previous embodiments of the device, the body massaging device may further include an electric, pneumatic or hydraulic driving mechanism. Correspondingly, the operation method may further include:

activating the electric, pneumatic or hydraulic driving mechanism, so as to drive various massaging assemblies of the massage assembly mounting bracket 1 to effectuate automatic massage, after various massaging assemblies mounted on the massage assembly mounting bracket 1 abut against corresponding positions of the body.

In further embodiments of the body massaging device, the body massaging device further includes a bearing garment. The corresponding operation method also further includes:

wearing the bearing garment at leg and waist-hip parts of the body, so as to bear the support holder by the bearing garment and at least partially wrapping the support holder and various massaging assemblies mounted on the support holder, after making various massaging assemblies mounted on the massage assembly mounting bracket 1 abut against corresponding positions of the body.

Next, by taking as an example a body massaging device including the bearing shorts, the anal massaging assembly, the penis massaging assembly, the perineum massaging assembly, and the sphincter massaging assembly, detailed description to the operational process of the body massaging device will be made as follows:

The user first clamps the leg clamping structure of the support holder on the front and rear sides of the thigh, and allows that the massaging assembly mounting bracket is located below the perineum between both legs, such that the protective housing of the rotary shaft disk is clamped by both legs of the user. Then, the user adjusts the angles and positions of the anal massaging arm, the perineum massaging arm, the penis massaging arm, and the like so as to substantially match various massaging parts on the body. The user may also choose a shape of the massaging head required to be used, and adjust the position of the massaging head, so that the penis is sleeved into the penis massaging head, the anal massaging head abuts against the anus, the perineum massaging head abuts against the perineum area, and the sphincter massaging head abuts against the anal sphincter. The user may use lubricant to adequately lubricate the body parts such as the penis, the anus, the perineum, and the peripheral skin as well as various massaging heads of the device, so as to make the massaging process more smooth and also reduce the damage to the skin.

When the user finishes mounting the support holder, it is possible to further put on the bearing shorts, and perform the tightening adjustment by means of the waist band, the pulling rope or the elastic rope of the waist-hip wrapping portion, so as to ensure the stability of the support holder, and allow that various massaging heads can be in a more adequate and close contact with the body using the wrapping effect of the bearing shorts.

The user may repeatedly and alternately perform slight bowing or erecting actions, or repeatedly and alternately perform slight squatting and erecting actions. That is, the crotch joint is repeatedly bent, straightened, bent and straightened, with no requirement for a great movement amplitude, so that each massaging head of the body massaging device may produce a slide rubbing and/or compressing effect over the penis, the anus, the anal sphincter, the perineum area, and the like at the same time, thereby stimulating the body to produce sexual excitement.

When the crotch joint is bent, the anal massaging head and the perineum massaging head are drawed by the support holder to slide forward with respect to the body, and at the same time, the penis massaging head slides upward with respect to the penis. When the body is upright, the anal massaging head and the perineum massaging head are drawed by the support holder to slide backward with respect to the body, and at the same time, the penis massaging head slides downward with respect to the penis. When the user walks at small steps, it is also possible to drive various massaging heads to produce a slide rubbing and compressing stimulation with respect to the aforementioned sensitive parts of the body.

The user may adjust the amplitude and frequency of the action according to own feeling. The continuous stimulating action will allow the body to generate sexual pleasure in the body and gradually reach an orgasm phase. The sexual pleasure at this time is usually a superposition of the penile pleasure and the anal (prostate) pleasure. When the body reaches the orgasm phase close to ejaculation, the amplitude of the action is reduced or the action is ceased. The action is resumed after the feeling of ejaculation is reduced, so that the body may be maintained in an orgasm state within a long time prior to ejaculation.

Since the anal (prostate) pleasure can be more persistent and continuous than the penile pleasure, if a long time of pleasure and orgasm is to be obtained, it is possible to reduce the stimulation strength of the penis whilst maintaining the stimulation magnitude by slide compressing the anus. The method of reducing the stimulation intensity of the penis may be to change for a less elastic, and slacker penis massaging head, or to change for a penis massaging cushion with a relatively flat and smooth inner surface. In the course of continuous stimulation, the user may timely add lubricant to ensure adequate lubrication of the parts at which various massaging heads are in contact with the skin of the body.

During each use of the body massaging device, the user may change massaging heads of different shapes, different sizes and different materials, or make a replacement by a massaging head with a vibration function, or adjust the relative position of a massaging head and a sensitive part of the body depending on own needs, so that different stimulation experiences may be obtained.

In addition to stimulation of the surface layer of the skin, the user may also combine a short anal massaging arm and an insertion-type prostate massager in use to stimulate the prostate, so as to obtain a more abundant effect of sexual excitement.

The present example not only may be used by the user alone, but also may be combined in use during sexual intercourse with a mate. That is, the user may remove the penis massaging arm to protrude the erect penis from the front opening of the bearing shorts, and along with the back-and-forth movement of the body of the male during the sexual intercourse, the anal massaging head and the perineum massaging head may simultaneously stimulate the corresponding sexually sensitive areas, so as to increase the erectile hardness of the penis of the male, and at the same time enhance the sexual pleasure of the male and the female.

Heretofore, various embodiments of the present disclosure have been described in detail. In order to avoid obscuring the concept of the present disclosure, some details commonly known in the art are not described. From the above descriptions, those skilled in the art may fully understand how to implement the technical solutions disclosed here.

Finally, it should be explained that: the aforementioned embodiments are only used to describe the technical solution of the present disclosure rather than limiting the same; although detailed explanations are made to the present disclosure by referring to preferred embodiments, a common technical person in the art should understand that: it is still possible to make amendments to the embodiments of the present disclosure or make equivalent replacements to part of the technical features; without departing from the spirit and scope of the present disclosure, they should all be covered in the scope of the technical solution for which protection is sought in the present disclosure.

What is claimed is:

1. A body massaging device, comprising:

a support holder, detachably mountable on a lower limb of a body; and an anal massaging assembly mounted on the support holder for compressing and/or rubbing massage on an anus and a perianal skin of the body;

wherein the body massaging device further comprises a penis massaging assembly mounted on the support holder for performing a compressing and/or rubbing massage on a penis of the body.

2. The body massaging device according to claim 1, wherein, the support holder comprises:

a leg clamping structure, for clamping and fixing to a leg of the body; and a massaging assembly mounting bracket, mountable on the leg clamping structure, for mounting various massaging assemblies.

3. The body massaging device according to claim 2, wherein, the leg clamping structure comprises at least one row of a pair of lateral arms juxtaposed in a linear shape, a curvilinear shape or a corrugated shape, for clamping and fixation by exerting an compressing force to front and rear sides of thighs of the body; or at least one set of enclosed fixing band, configured to be sleeved on a thigh of the body whilst exerting a compressing force for clamping and fixation.

4. The body massaging device according to claim 2, wherein, the massaging assembly mounting bracket is configured to be positioned between both legs of the body when the leg clamping structure is configured to clamp and fix to a leg of the body, so that the massaging assembly mounted on the massaging assembly mounting bracket moves relative to the body along with a motion of the leg when the leg of the body performs a preset action.

5. The body massaging device according to claim 3, wherein, a distance between the pair of lateral arms is configured to be adjustable so as to adapt to leg sizes of different bodies or different leg parts of the body.

6. The body massaging device according to claim 1, wherein, the anal massaging assembly comprises:

an anal massaging arm, mounted on the support holder; and an anal massaging head, which is mounted at one end of the anal massaging arm and configured to exert a compressing force to an anal part under the effect of the anal massaging arm, so as to effectuate a compressing massage on the anus as well as the perianal skin, and which is configured to perform a rubbing massage on the anus as well as the perianal skin by movement of the anal massaging head on the anal massaging arm or movement of the same along with movement of the anal massaging arm.

7. The body massaging device according to claim 6, wherein, the anal massaging arm is rotatably connected to the support holder by means of a rotary shaft disk provided on the support holder, and an elastic element provided between the anal massaging arm and the support holder is configured to exert a torque towards the anal massaging arm, so that the anal massaging head compresses the anus and the perianal skin.

8. The body massaging device according to claim 7, wherein, an elastic force of the elastic element is adjustable.

9. The body massaging device according to claim 6, wherein, the anal massaging head is detachable, replaceable and/or adjustable in position with respect to the anal massaging arm.

10. The body massaging device according to claim 1, further comprising a sphincter massaging head and a sphincter massaging arm which is selectively provided, wherein, the sphincter massaging head is mounted on the anal massaging assembly and/or the support holder directly or by means of the sphincter massaging arm, and located on left and right sides or front and rear sides of the anal massaging assembly, for performing a compressing and/or rubbing massage on the anal sphincter.

11. The body massaging device according to claim 1, wherein, the penis massaging assembly comprises:

a penis massaging arm mounted on the support holder; and a penis massaging head mounted at one end of the penis massaging arm, for exerting a compressive force to the penis, so as to effectuate a compressing massage on the penis, and performing a rubbing massage on the penis along with movement of the penis with respect to the penis massaging head.

12. The body massaging device according to claim 11, wherein, the penis massaging head comprises an at least partially enclosed tubular structure, or a plurality of at least partially enclosed annular structures arranged along a length direction of the penis massaging arm, in which a hollow portion of the tubular structure or the annular structure is configured to receive the penis.

13. The body massaging device according to claim 12, wherein, the tubular structure or the annular structure is an elastic structure or is made of an elastic material, or an inner wall of the tubular structure or the annular structure is an elastic structure or is made of an elastic material, or an inner wall of the tubular structure or the annular structure is configured in a contour shape that substantially matches an outer contour of the penis, or an entirety or an inner wall portion of the tubular structure or the annular structure is a non-elastic structure or is made of a non-elastic material.

14. The body massaging device according to claim 1, further comprising a perineum massaging assembly mounted on the support holder, the anal massaging assembly and/or the penis massaging assembly for performing a compressing and/or rubbing massage on a perineum of the body.

15. The body massaging device according to claim 14, wherein, the perineum massaging assembly comprises a perineum massaging head and a perineum massaging arm which is selectively provided, in which the perineum massaging head is mounted on the support holder, the anal massaging assembly and/or the penis massaging assembly directly or by means of the perineum massaging arm.

16. The body massaging device according to claim 1, further comprising an insertion-type prostate massager mounted on the support holder directly or by means of the anal massaging assembly, for insertion into the anus to perform a compressing and/or rubbing massage on a prostate interior to the anus.

17. The body massaging device according to claim 1, further comprising a bearing garment wearable on at least leg and waist-hip parts of the body, and bearing the support holder, to assist in fixation of the support holder on the lower limb of the body, the bearing garment further at least partially wrapping the support holder and various massaging assemblies mounted on the support holder, so as to assist various massaging assemblies to approach corresponding positions of the body.

18. The body massaging device according to claim 17, wherein, the bearing garment is a bearing shorts, wherein, an upper side of the bearing shorts is provided with a waist-hip wrapping portion which has a waist belt, a pulling rope or an elastic rope for adjusting a wrapped size, a lower side of the bearing shorts is provided with leg wrapping portions wrapping the thighs of the body, and a crotch wrapping portion is provided between the leg wrapping portions at both sides, such that the waist-hip wrapping portion, the leg wrapping portions and the crotch wrapping portion jointly bear the support holder, and jointly wrap the support holder and various massaging assemblies on the support holder.

19. The body massaging device according to claim 18, wherein, a vest band is mounted on the waist-hip wrapping portion, the vest band being connected to the support holder and various massaging assemblies mounted on the support holder, to assist in a bearing effect of the bearing shorts.

20. A method of operating the body massaging device according to claim 1, comprising:

mounting the support holder on a lower limb of a body and making the anal massaging assembly abut against a position of an anus of the body; and making the anal massaging assembly perform a compressing and/or rubbing massage on the anus and the perianal skin of the body by a predetermined repetitive action performed by the body.

21. The operation method according to claim 20, wherein, the predetermined repetitive action is a repeated flexion and extension action of a waist or a knee in a standing state of the body.

22. The operation method according to claim 20, wherein, the support holder comprises: a leg clamping structure for clamping and fixing a leg of the body and a massaging assembly mounting bracket mounted on the leg clamping structure and for mounting various massaging assemblies; the operation method further comprises:

making the various massaging assemblies mounted on the massaging assembly mounting bracket abut against corresponding positions of the body when the support holder is mounted on the leg of the body; and making the various massaging assemblies perform a compressing and/or rubbing massage on corresponding positions of the body when the body performs a predetermined repetitive action.

* * * * *